US012728954B1

(12) United States Patent
Krammer

(10) Patent No.: US 12,728,954 B1
(45) Date of Patent: Sep. 8, 2026

(54) MARINE VESSELS WITH BOARD STORAGE SYSTEM

(71) Applicant: Brunswick Corporation, Mettawa, IL (US)

(72) Inventor: Christopher D. Krammer, Deltona, FL (US)

(73) Assignee: Brunswick Corporation, Mettawa, IL (US)

( * ) Notice: Subject to any disclaimer, the term of this patent is extended or adjusted under 35 U.S.C. 154(b) by 321 days.

(21) Appl. No.: 18/609,878

(22) Filed: Mar. 19, 2024

(51) Int. Cl.
*B63B 11/00* (2006.01)
*B63B 32/83* (2020.01)

(52) U.S. Cl.
CPC ..... *B63B 11/00* (2013.01); *B63B 32/83* (2020.02)

(58) Field of Classification Search
CPC ..... B65B 11/00; B65B 32/83
See application file for complete search history.

(56) References Cited

U.S. PATENT DOCUMENTS

| | | | | |
|---|---|---|---|---|
| 116,934 | A | 7/1871 | Cutter | |
| 982,710 | A | 1/1911 | Edmund | |
| 3,004,792 | A | 10/1961 | Bell | |
| 5,136,963 | A | 8/1992 | Zuzik | |
| 7,370,559 | B2 | 5/2008 | Kamo | |
| 8,899,169 | B1 | 12/2014 | Jaziri | |
| 9,021,975 | B1 | 5/2015 | Fodor | |
| 10,085,556 | B2 | 10/2018 | Chien | |
| 10,994,810 | B1 | 5/2021 | Scheele et al. | |
| 2017/0238700 | A1* | 8/2017 | Davis | A47B 43/04 |

FOREIGN PATENT DOCUMENTS

| | | | | |
|---|---|---|---|---|
| CN | 214397122 U | * | 10/2021 | |
| CN | 117985385 A | * | 5/2024 | B65G 1/0421 |

OTHER PUBLICATIONS

"Pull Out Ski Tow" accessed from https://www.whitecapmarineproducts.com/products/pull-out-ski-tow-2-9-16-6957 on Mar. 8, 2024.

* cited by examiner

*Primary Examiner* — Sheetal R Paulson
(74) *Attorney, Agent, or Firm* — Andrus Intellectual Property Law, LLP

(57) ABSTRACT

A marine vessel includes a hatch permitting access into a cavity, a cover on the hatch, the cover being movable into an open position to open the hatch and a closed position to close the hatch, and shelving that defines slots for storing boards. The shelving being moved into an extended position when the cover is moved into the open position, the extended position facilitating insertion of boards into the slots, and the shelving being moved into a collapsed position when the cover is moved into the closed position, the collapsed position facilitating storage of the boards in the cavity.

20 Claims, 15 Drawing Sheets

MARINE VESSELS WITH BOARD STORAGE SYSTEM

FIELD

The present disclosure relates to marine vessels and specifically to accessories for marine vessels such as board storage systems, gates, and seats.

BACKGROUND

The following U.S. Patents are incorporated herein by reference in entirety.

U.S. Pat. No. 7,370,599 discloses a multi-purpose boat tower having a unitary device with discrete and integral components including a rigid frame cage mounted to a portion of the deck and transom of a boat, a horizontal platform removably mounted to the top of the rigid frame, a plurality of foldable rack structures mounted to the rigid frame, a plurality of fishing rod holders mounted to the rigid frame and a rigid pylon structure mounted to the top of the rigid frame.

U.S. Pat. No. 8,899,169 discloses a platform for a vessel that includes integrated and stowable seating. The platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform. The open seating position provides an aftward seating configuration.

U.S. Pat. No. 9,021,975 discloses a seating system for marine vessels and watercraft including a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft. The seating system is convertible between a forward-facing seat configuration and an aft-facing lounger configuration.

U.S. Pat. No. 10,994,810 discloses a rail system for a marine vessel having an upper deck. The rail system has a set of forward rails that encloses a portion of the upper deck, where the set of forward rails includes a front rail and folding side rails. The set of forward rails is pivotable between an up position and a down position. A plurality of floor hinges pivotally couple the folding side rails to the upper deck. The set of forward rails has an up height when in the up position and a down height when in the down position that is lower than the up height.

U.S. Pat. No. 10,085,566 discloses a marine vessel having a deck surface having a recessed cavity; a seat module having a seating member, an engagement member, and a hinge that couples the seating member to the engagement member; and a retainer configured to retain the engagement member with respect to the recessed cavity. The seating member is pivotable about the hinge into and between a closed position in which the seating member lies flush with the deck surface and covers the recessed cavity and an open position in which the seating member provides seating for user and the recessed cavity is exposed and provides leg room for the user.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain independent examples, a marine vessel includes a hatch permitting access into a cavity, a cover on the hatch, the cover being movable into an open position to open the hatch and a closed position to close the hatch, and shelving that defines slots for storing boards. The shelving being moved into an extended position when the cover is moved into the open position, the extended position facilitating insertion of boards into the slots, and the shelving being moved into a collapsed position when the cover is moved into the closed position, the collapsed position facilitating storage of the boards in the cavity.

Optionally, moving the cover into the closed position collapses the shelving and brings the boards closer together. Optionally, the shelving comprises a flexible material that collapses upon closing of the cover. Optionally, the shelving comprises a canvas material. Optionally, the slots are arranged in a stack, each slot having an open end for receiving one of the boards and a closed end opposite the open end. The open ends are collapsed upon moving the cover into the closed position. Optionally, an end wall defines the closed end of each slot. Optionally, the shelving includes shelves which collapse towards each other when the cover is moved into the closed position. Optionally, the shelving includes a flexible support member on each side of the shelving, the flexible support members being coupled to the cover and each of the shelves. Optionally, each shelf is coupled to and spaced apart along the flexible support members. Optionally, the flexible support members are located closer to the open end than the closed end. Optionally, the flexible support members are a first pair of flexible support members having a flexible support member located on each side of the shelving, and further comprising a second pair of flexible support members having a flexible support member located on each side of the shelving. Optionally, the cover is provided by a seat for the marine vessel. Optionally, the seat includes a seat back and a seat bottom which are transversely oriented relative to each other. Optionally, the shelving comprises a flexible material coupled to the cover and configured to move with the cover. Optionally, the cover is pivotable into and between the open position and the closed position. Optionally, a gas spring is for assisting movement of the cover toward at least one of the open position and the closed position. Optionally, a latch retains the cover in the closed position and is operable to permit movement of the cover into the open position. Optionally, the hatch faces a stern of the marine vessel. Optionally, the cover is provided by a seat of the marine vessel, and wherein the seat includes a seat bottom and a seat back, the seat back facing the stern when the cover is in the closed position. Optionally, the marine vessel includes a deck and a hull, the cavity being at least partially defined between the deck and the hull.

In certain independent examples, a marine vessel includes a sidewall and a cavity and a gate movable into and between an extended position in which the gate extends upwardly from the sidewall and a retracted position in which the gate is recessed into the cavity.

Optionally, the gate is slidable into and between the extended position and the retracted position. Optionally, marine vessel has a hull at least partially defines the cavity in which the gate is received. Optionally, the marine vessel has a hull to which the gate is mounted. Optionally, marine vessel has a stern and the sidewall is located at the stern. Optionally, a toe line latch that is coupled to and moveable with the gate and for retaining a toe line. Optionally, the toe line latch is movable into and between an up position for connection to the toe line and a down position within the gate. Optionally, the gate includes a pair of legs having one or more pins which extend into slots. Optionally, the slots are defined by one or more brackets. Optionally, each leg in the pair of legs has two pins extending therefrom and the pins on each leg are vertically offset from each other. Optionally, the gate includes a pair of legs and a top rail extending between the legs. Optionally, when the gate is in the retracted position the top rail is in a recess. Optionally, a first lock locks the gate in the extended position. Optionally, a second lock locks the gate in the retracted position. Optionally, an actuator is configured to be engaged such that the first lock unlocks the gate. Optionally, a spring prevents the gate from free falling into the retracted position. Optionally, the marine vessel includes a marine drive and a user interface device, the user interface device configured to alert an occupant when the gate is in the retracted position and the marine drive is engaged to propel the marine vessel in water.

In certain independent examples, a marine vessel includes a hull comprising a bow, an opposite stern, and a sidewall, the hull further at least partially defining a cavity therein. A gate is located at the stern, the gate is movable into an extended position in which the gate extends upwardly from the sidewall and into a retracted position in which the gate is withdrawn into the cavity. A seat including a seat bottom and a seat back such that the seat back is movable into and between a raised position in which the seat back provides a backrest for an occupant sitting on the seat bottom and a lowered position permitting the occupant to walk over the seat from a deck.

Optionally, a lock is for locking the seat back in the raised position and unlocking from the seat back such that the seat back can be moved into the lowered position and a step is configured to actuate an actuator such that stepping on the step causes the actuator to unlock the lock. Optionally, moving the gate to the retracted position and moving the seat back in the lowered position provides a walkway from the stern past the seat towards the bow. Optionally, the step is one of a first step and a second step configured to enabling the occupant to walk up and then over the seat. Optionally, a platform is located behind the stern, and a gallery section located between the stern and the seat, such that moving the gate in the retracted position and moving the seat back into the lowered position permits the occupant to walk from the platform over the gate onto the gallery section, and from the gallery section onto a step which facilitates moving of the seat back into the lowered position, enabling the occupant to then walk over the seat to a forward portion of the marine vessel.

In certain independent examples, a seat for a marine vessel includes seat bottom, a seat back that is movable into a raised position providing a backrest for an occupant sitting on the seat bottom and alternately into a lowered position permitting the occupant to walk over the seat, a lock for selectively locking the seat back in the raised position and unlocking from the seat back such that the seat back can be moved into the lowered position, and a step configured such that stepping on the step unlocks the lock from the seat back.

Optionally, an actuator causes the lock to unlock from the seat back when stepping on the step. Optionally, the step is located in a cutout defined by the seat bottom. Optionally, the step is located in a cutout defined by the seat back when the seat back is in the lowered position. Optionally, the step is located below the seat back when the seat back is in the raised position. Optionally, the step is a first step and a second step is provided, wherein stepping on the first step or the second step unlocks the lock from the seat back. Optionally, a first actuator is operably coupled to the first step that causes the lock to unlock from the seat back when stepping on the first step and a second actuator is operably coupled to the second step that causes the lock to unlock from the seat back when stepping on the second step. Optionally, the first step being positioned lower than the second step enabling the occupant to walk up and then over the seat. Optionally, the first step is positioned in a cutout in the seat bottom and the second step being positioned in a cutout in the seat back when in the lowered position. Optionally, the lock includes a lock member that engages the seat back in the raised position and further comprising a cable that operably couples the step to the lock such that stepping on the step unlocks the lock from the seat back. Optionally, the lock is a first lock and further comprising a second lock, and the first lock and the second lock are located adjacent opposite sides of the seat back. Optionally, a cable that operably couples the step to the first lock and the second lock such that stepping on the step unlocks the first lock and the second lock from the seat back. Optionally, the step is a first step and a second step is provided, wherein stepping on the first step or the second step unlocks the first lock and the second lock from the seat back. Optionally, a first actuator is operably coupled to the first step that causes the first lock and the second lock to unlock from the seat back when stepping on the first step and a second actuator is operably coupled to the second step that causes the first lock and the second lock to unlock from the seat back when stepping on the second step.

In certain independent examples, a marine vessel includes a deck, a seat including a seat bottom and a seat back, the seat back is movable into a raised position providing a backrest for an occupant sitting on the seat bottom and alternately into a lowered position permitting the occupant to walk over the seat from the deck, a lock for selectively locking the seat back in the raised position and unlocking from the seat back such that the seat back can be moved into the lowered position, and a step configured such that stepping on the step unlocks the lock from the seat back.

Optionally, the marine vessel includes a bow and a stern. The deck has a gallery section located between the seat and the stern, and the seat permits the occupant to walk from the gallery section onto the step which facilitates lowering of the seat back into the lowered position and thereby permits an occupant to then walk over the seat toward the bow. Optionally, the step is located in a cutout defined by the seat bottom. Optionally, the step is located in a cutout defined by the seat back when the seat back is in the lowered position. Optionally, the step is a first step and a second step is provided, wherein stepping on the first step or the second step unlocks the lock from the seat back. Optionally, the first step is positioned lower than the second step enabling the occupant to walk up and then over the seat. Optionally, moving the seat back to the lowered position provides a walkway from the stern past the seat towards the bow.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The present inventors, through research and experimentation in the field of marine vessels, recognized that the marine vessels can include a wide variety of equipment and accessories that increase utility and/or operator enjoyment of the marine vessel. The present inventors determined it would be advantageous to develop new equipment and accessories such as board storage system, gates, and seats, examples of which are described in the present disclosure, to further increase the utility and/or the operator enjoyment of marine vessels. The marine vessels can vary such as a fishing boats, ski boats, yachts, catamarans, and the like.

Figure 1:
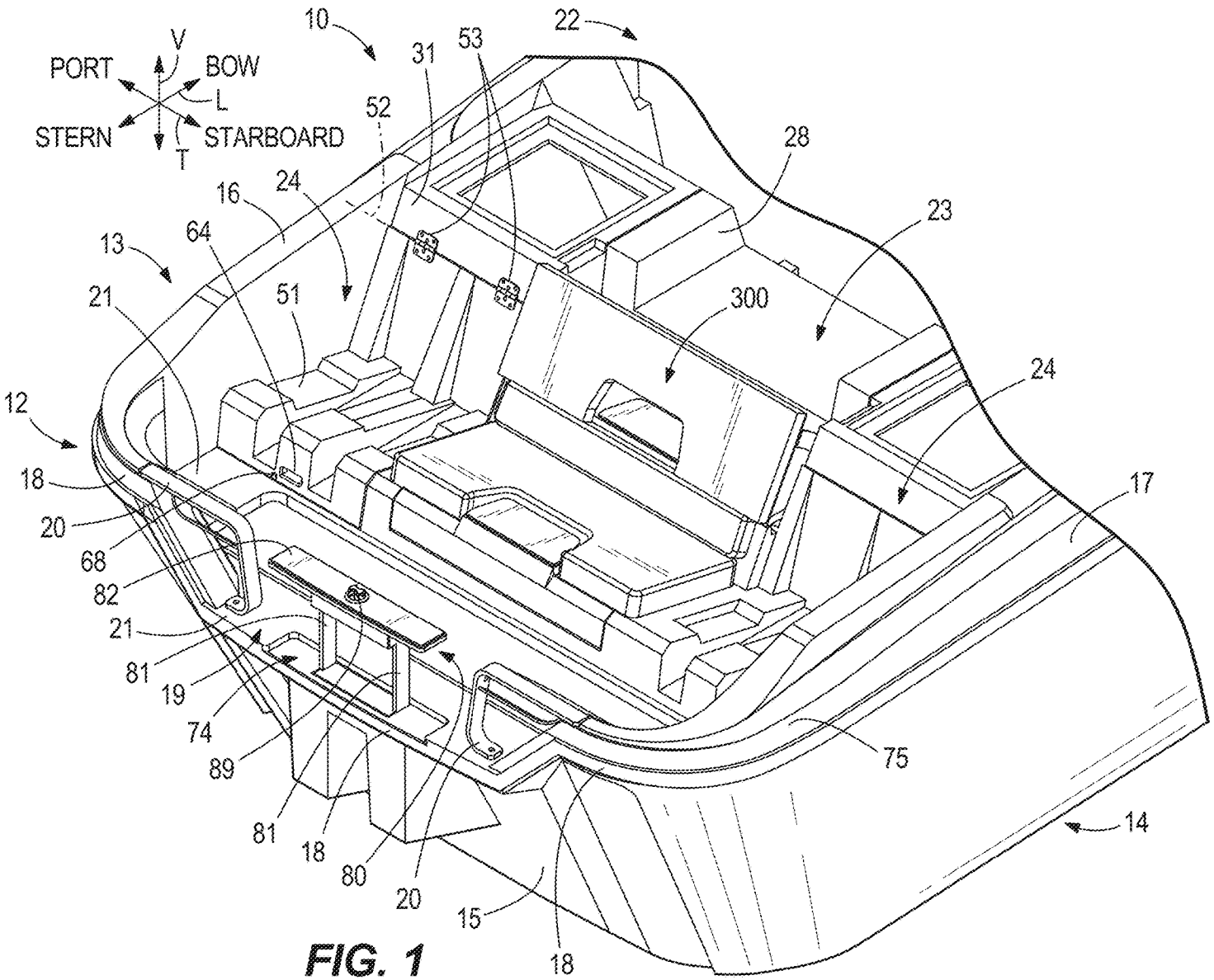
FIG. 1 is a perspective view of a stern of an example marine vessel according to the present disclosure with a cover in a closed position.

FIG. 1 depicts a stern 12 of an example marine vessel 10 according to the present disclosure. The marine vessel 10 also includes an opposite bow 22 which is schematically depicted by arrow 22 which points in the direction of the bow 22. The bow 22 is longitudinally (see longitudinal axis L) offset from the stern 12. The marine vessel 10 also includes a port side 13 and an opposite starboard side 14. The marine vessel 10 has a hull 15 for supporting one or more components and/or systems of the marine vessel 10. The hull 15 includes a plurality of sidewalls, such as a first sidewall 16 located along the port side 13 (also referred to as a port sidewall 16 herein), a second sidewall 17 located along the starboard side 14 (also referred to as a starboard sidewall 17 herein), and a third sidewall 18 located along the stern 12 (also referred to as a stern sidewall 18 herein). The stern sidewall 18 extends between the port and starboard sidewalls 16, 17. Note that in certain examples the stern sidewall 18 has a plurality of sections. For instance, the stern sidewall 18 depicted in FIGS. 1 and 7 has a first section located near the port side 13 that has the same top surface elevation relative to a deck 21 of the marine vessel 10 as a second section located near the starboard side 14. Two sloped sections extend between the first and second sections to a third section that has at top surface elevation that is near the deck 21. The stern sidewall 18 defines an access cutout 19 through which an operator or a water skier may pass to board and/or disembark from the marine vessel 10.

One or more handles 20 used by the operator or a water skier to board and/or disembark the marine vessel 10 are coupled to the stern sidewall 18 and extend into the cutout 19. In certain examples, a platform (not depicted; e.g., a swim platform or a sunbathing platform) longitudinally extends away from the stern 12 of the marine vessel 10 into or above the water.

The marine vessel 10 has a deck 21 for supporting the operator and the occupants of the marine vessel 10. The deck 21 can also support a frame 28 of the marine vessel 10 thereon. The frame 28 laterally (see example lateral axis T) extends between the port and starboard sidewalls 17, 18. The frame 28 is for supporting various components and systems of the marine vessel 10.

Figure 2:
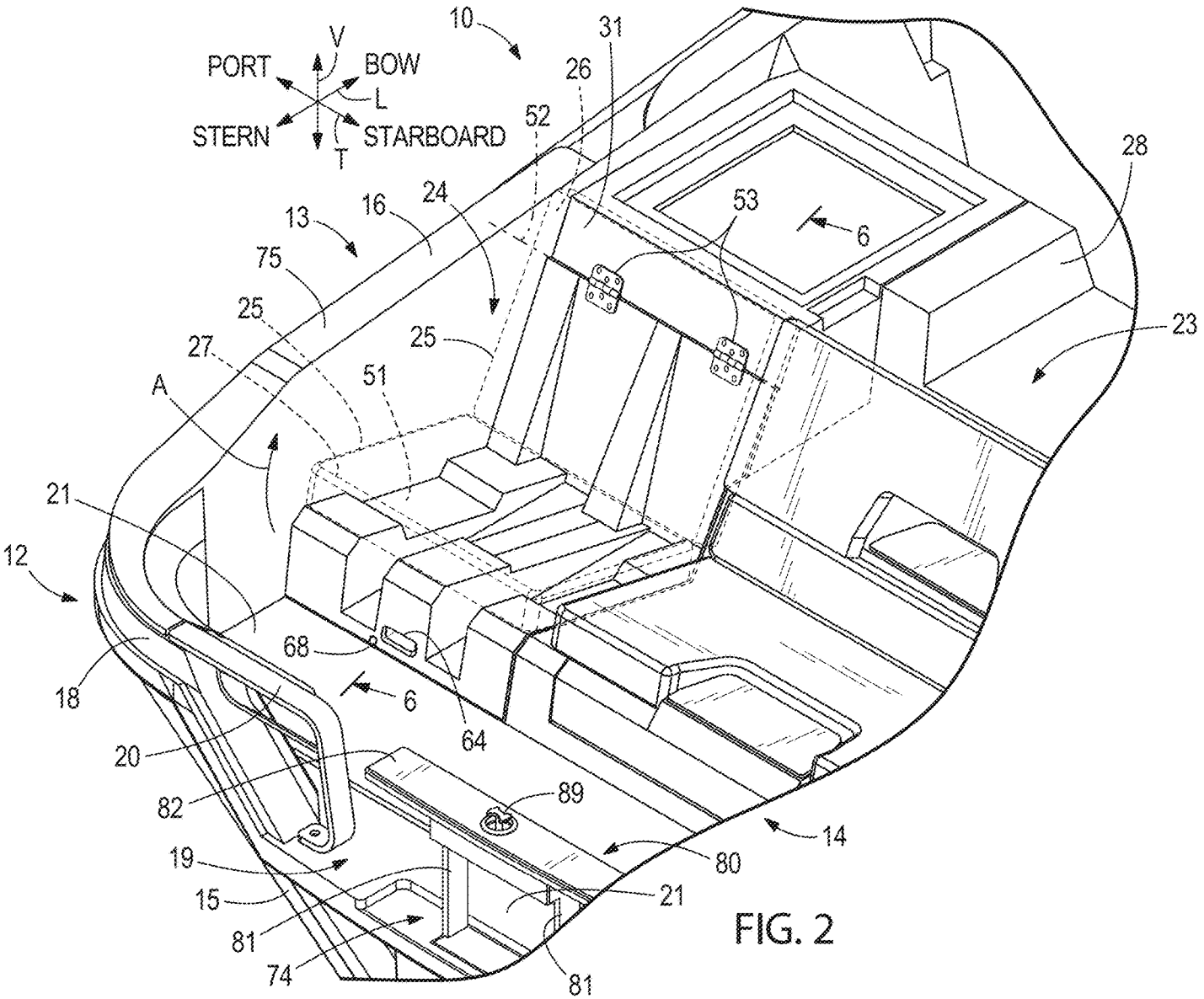
FIG. 2 is another perspective view of the stern of the example marine vessel of FIG. 1 with the cover in the closed position.
Figure 3:
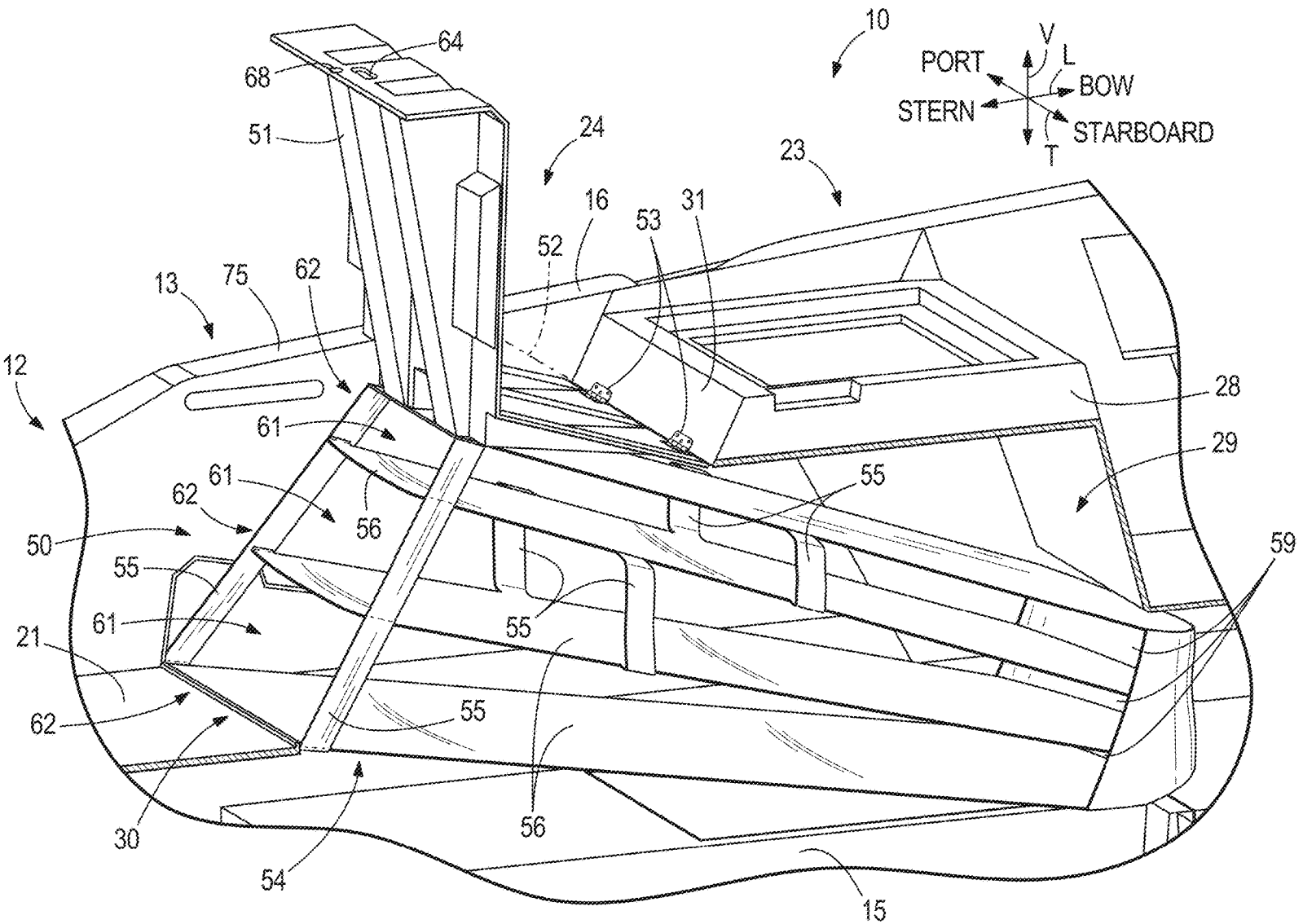
FIG. 3 is a cutaway view of the marine vessel of FIG. 2.

A seating system 23 is provided on the marine vessel 10, and the seating system 23 includes one or more seats 24, 300 which in the example marine vessel 10 depicted in FIGS. 1-2 are supported on the frame 28. One example seat 24 is located adjacent the port sidewall 16 with a similar seat 24 located adjacent to the starboard sidewall 17. A third seat 300 is positioned between the seats 24 along the sidewalls 16, 17. FIG. 2 schematically depicts cushions 25 (see dashed lines) for the seat 24 adjacent to the port sidewall 16. The seats 24, 300 provide a sitting location(s) for the occupant(s) near the stern 12 of the marine vessel 10. The seats 24, 300 can be rear or stern facing depending on the position of the seats 24, 300 (described further herein). Note that the location of the seats 24, 300 can vary, and the present disclosure includes other example seating systems 23 in which the number and/or location of the seats 24, 300 varies from the example seating system 23 depicted in FIG. 1. (e.g., another example seating system 23 have the seat 300 located adjacent to the port sidewall 16 and only one other seat 24 adjacent to the starboard sidewall 17).

It should be understood that in other examples, the frame 28 could be provided by any other suitable support structure(s), for example a portion of the hull 15 extending between the starboard and the port sidewalls 16, 17. Furthermore, the frame 28 can be a separate component from the deck 21, the hull 15, and/or a seating system or component of and/or internally formed with the deck 21, the hull 15, and/or a seating system 23. It should also be understood that the type and configuration of the marine vessel 10 can vary from what is shown, and that the location of the seats 24, 300 can vary from what is shown. In certain examples, the frame 28 does not define a center hatch.

Referring now to FIGS. 2-6, an example board storage system 50, according to the present disclosure is depicted. The board storage system 50 is for storing one or more boards 11, such as surf boards, skim boards, wakeboards, and the like, on the marine vessel 10. The board storage system 50 advantageously stores the board 11 which would otherwise clutter the deck 21 and/or obstruct movement of occupants on the deck 21. The board storage system 50 also prevents the boards 11 from inadvertently falling off the marine vessel 10.

The board storage system 50 is movably positioned in a cavity 29 (see FIG. 3) which at least partially defined by the frame 28, the hull 15, and/or the deck 21. The frame 28 also defines a hatch 30 through which the cavity 29 is accessible. In certain examples, the hatch 30 faces the stern 12.

A cover 51 for selectively covering the hatch 30. The cover 51 is movable into and between an open position (FIGS. 3-5) to open the hatch 30 and a closed position (FIGS. 2 and 6) to close the hatch 30. The cover 51 supports one or more cushions 25 (depicted in dashed lines in FIG. 2) thereon such that the cushions 25 move with the cover 51. The cushions 25 are part of a seat back 26 that supports the back of the occupant and a seat bottom 27 on which the occupant sits. The seat back 26 and the seat bottom 27 are transversely oriented relative to each other.

The cover 51 may move into and between the open and the closed positions in any suitable manner. In one non-limiting example, the cover 51 is movably coupled to a headrest panel 31 of the frame 28. In one example, the cover 51 is pivotably coupled to the headrest panel 31 and pivots about a transversely extending axis 52. In certain examples, hinges 53, or other known devices suitable for facilitating pivoting of the cover 51 about the pivot axis 52 and/or relative to the headrest panel 31, couple the cover 51 to the headrest panel 31. In certain examples, an actuator 67 (schematically depicted in FIGS. 5-6) is for assisting with moving the cover into and/or between at least one of the open position and the closed position. The type of actuator 67 can vary, and in one non-limiting example, the actuator 67 is a gas spring that has a first end coupled to the frame 28 and a second end coupled to the cover 51. In another example, the actuator 67 is an electrically powered linear actuator.

In certain examples, the cover 51 is a component in the board storage system 50. In these examples, the components forming the seat 24 (e.g., cushions 25) are coupled to the cover 51. In other examples, the cover 51 is a component of the seat 24.

Figure 4:
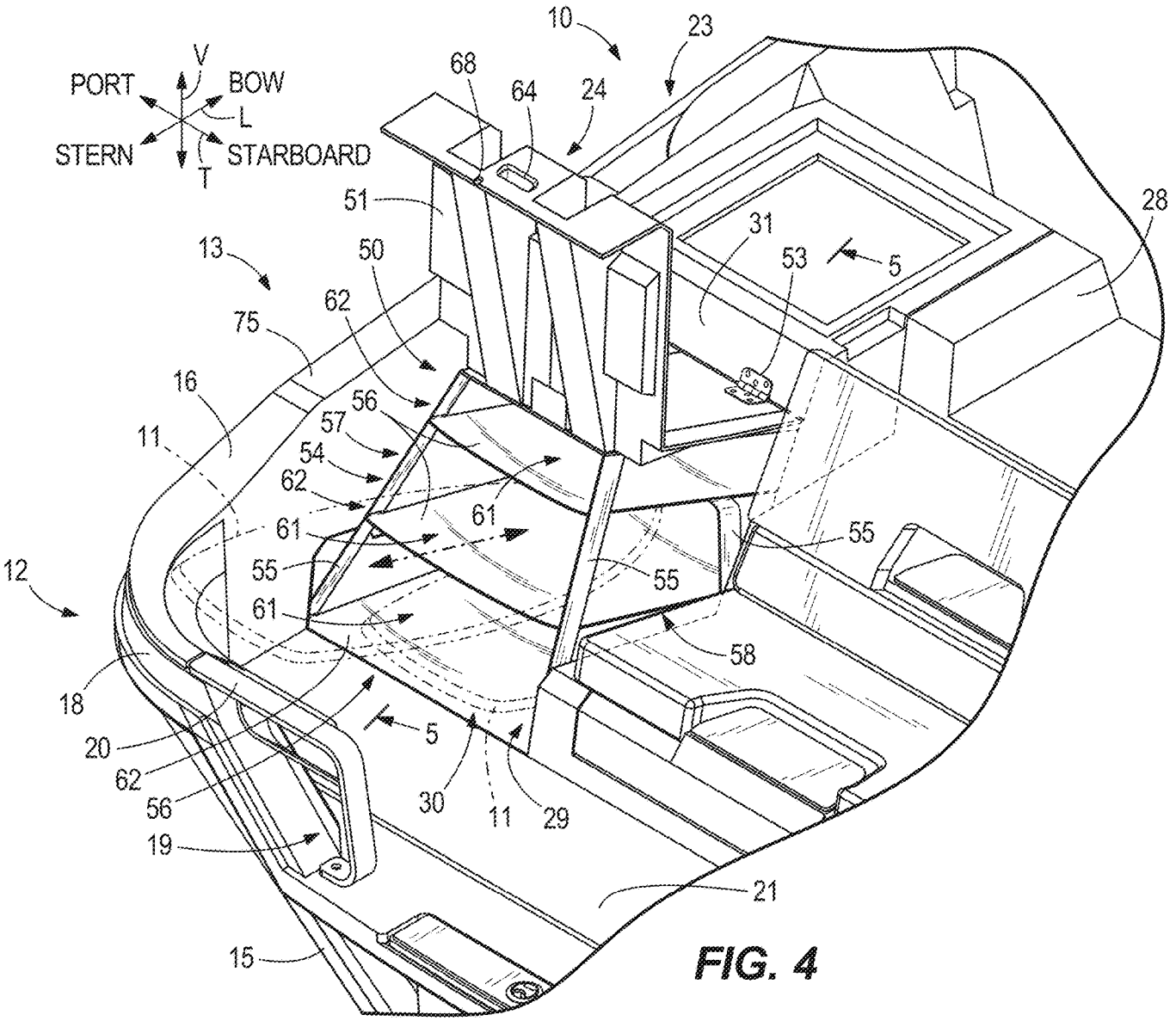
FIG. 4 is another perspective view of the stern of the example marine vessel like FIG. 2 with the cover in an open position.
Figure 5:
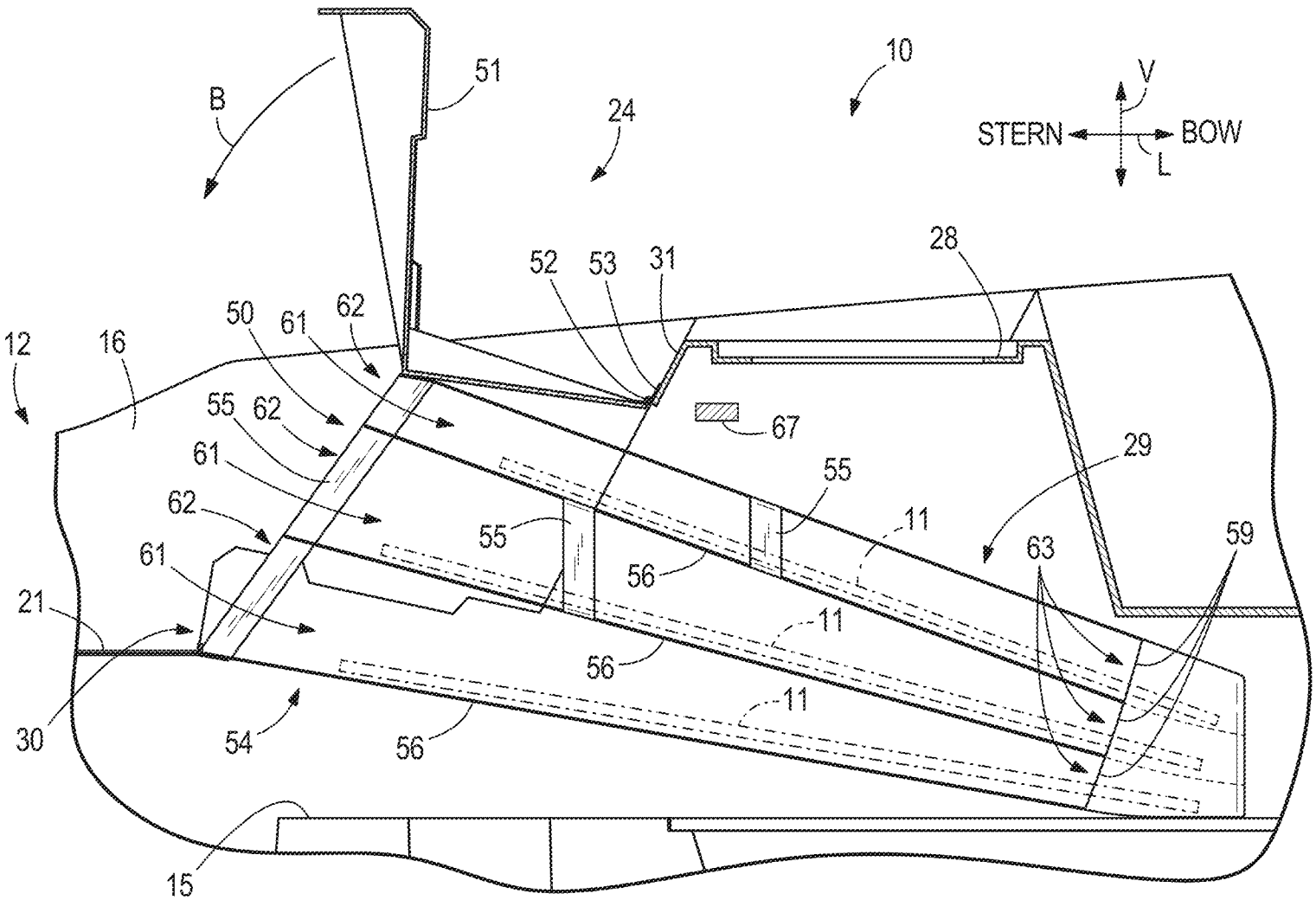
FIG. 5 is a cross-sectional view of the marine vessel of FIG. 2 along line 5-5 in FIG. 4 with the cover in the open position.
Figure 6:
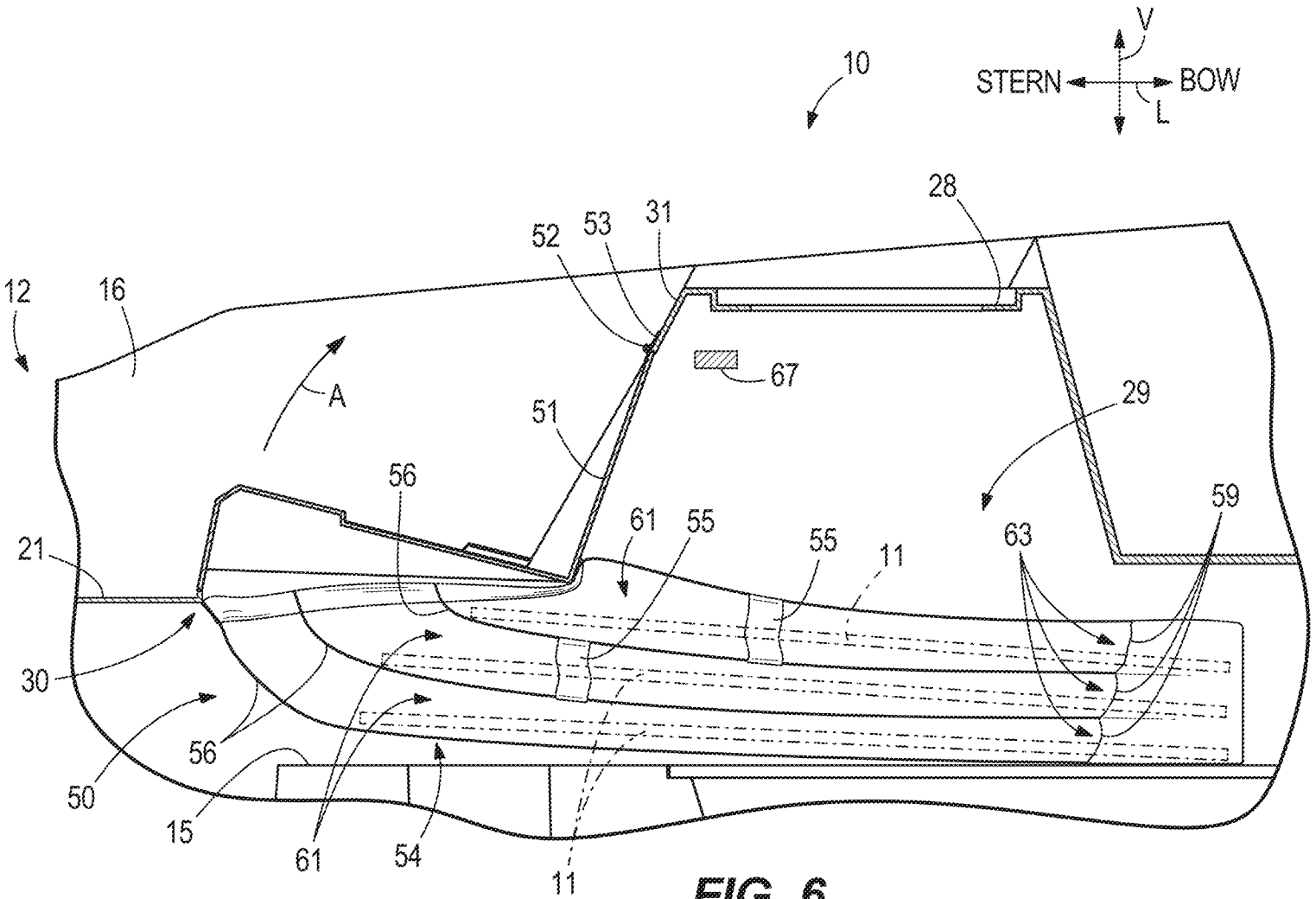
FIG. 6 is a cross-sectional view of the marine vessel of FIG. 2 along line 6-6 in FIG. 2 with the cover in the closed position.

The board storage system 50 includes shelving 54 for storing the boards 11 (the boards 11 are depicted as dash-dot lines in FIGS. 4 and 5-6). The shelving 54 includes one or more shelves 56 on which the boards 11 are located. The shelving 54 has a first side 57 and an opposite side 58.

One or more slots 61 are at least partially defined by the shelves 56. Each slot 61 has an open end 62 and an opposite closed end 63. An end wall 59 is at the closed end 63. The slots 61 are arranged in a stack of slots 61.

One or more flexible support members 55 (e.g., straps) extend between and couple adjacent shelves 56 to each other. One or more of the flexible support members 55 can also couple to the deck 21. For example, two flexible support members 55 on each side of the stack of shelves 56 and the stack of slots 61 at the open ends 62. In this example, the two flexible support members 55 extend along the slots 61 and couple to the deck 21, each shelf 56, and the cover 51. In this example, the flexible support member 55 is located closer to the open ends 62 than the closed ends 63. Note that the location at which the support members 55 coupled to the cover 51 can vary, and a person of ordinary skill in the art will recognize that the support members 55 will be coupled to the cover 51 in location that allows for proper operation of the board storage system 50 as described herein and/or based on the application of the board storage system 50 to various marine vessels 10.

The flexible support members 55 support each shelf 56 relative to each other, and each shelf 56 is coupled to and spaced apart along the flexible support member 55. The shelves 56 are sloped axially downwardly (see example vertical axis V) in a direction from the stern 12 toward the bow 22. The sloped shelves 56 advantageously reduces the risk that the boards 11 will inadvertently slide in a direction from the bow 22 toward the stern 12 off the shelves 56.

The flexible support members 55 and/or the shelf 56 can be formed of any suitable material and/or combination of materials. In certain examples, the flexible support members 55 and/or the shelf 56 comprise flexible material. In certain examples, the flexible support members 55 and/or the shelf 56 comprise canvas material. In certain examples, the shelf 56 comprises a rigid planar material wrapped in a flexible material.

An example operational sequence of the board storage system 50 is described herein below. FIG. 2 depicts the cover 51 in the closed position. The operator engages a handle 64 at the free end of the cover 51 and moves to the cover 51 in a first direction (see arrow A in FIG. 2) such that the cover 51 pivots about the axis 52 into the open position (see FIGS. 3-5). In certain examples, the operator must first operate a latch 68 which is configured to retain the cover 51 in the closed position before moving the cover 51 toward the open position. The latch 68 being operable to permit movement of the cover 51 into the open position.

As the cover 51 is pivoted into the open position, the shelving 54 is automatically moved from a collapsed position (see FIG. 6) into an extended position (FIGS. 3-5) facilitating insertion of boards 11 into the slots 61 and/or removal of the boards 11 from the slots 61. Note that the boards 11 are spaced apart from each other when the shelving 54 is in the extended position.

After the boards 11 are inserted or removed from the slots 61, the cover 51 is pivoted in a second direction (see arrow B in FIG. 5) into the closed position (FIGS. 2 and 6) such that the shelving 54 is moved into the collapsed position thereby facilitating storage of the boards 11 in the board storage system 50 and the cavity 29. Moving the cover 51 into the closed position collapses the shelving 54 and brings the boards 11 closer together to each other and brings the shelves 56 closer together to each other. Also, the open end(s) 62 of the slots 61 are collapsed upon themselves moving the cover 51 into the closed position. This 'collapsing' of the shelving 54 is akin to an accordion motion or movement.

To remove one or more boards 11 from the board storage system 50, the operator pivots the cover 51 in the first direction (see arrow A in FIG. 6) from the closed position (FIG. 6) to the open position (FIG. 5). As such, the operator can remove one or more boards 11 from the shelving 54.

Referring now to FIGS. 7-12, an example gate 80 according to the present disclosure is depicted. The gate 80 is for preventing occupants on the marine vessel 10 from inadvertently falling off the marine vessel 10 over the stern 12.

The gate 80 is advantageously movable (described further herein) such that the occupants can easily move past the gate 80 as needed.

Figure 7:
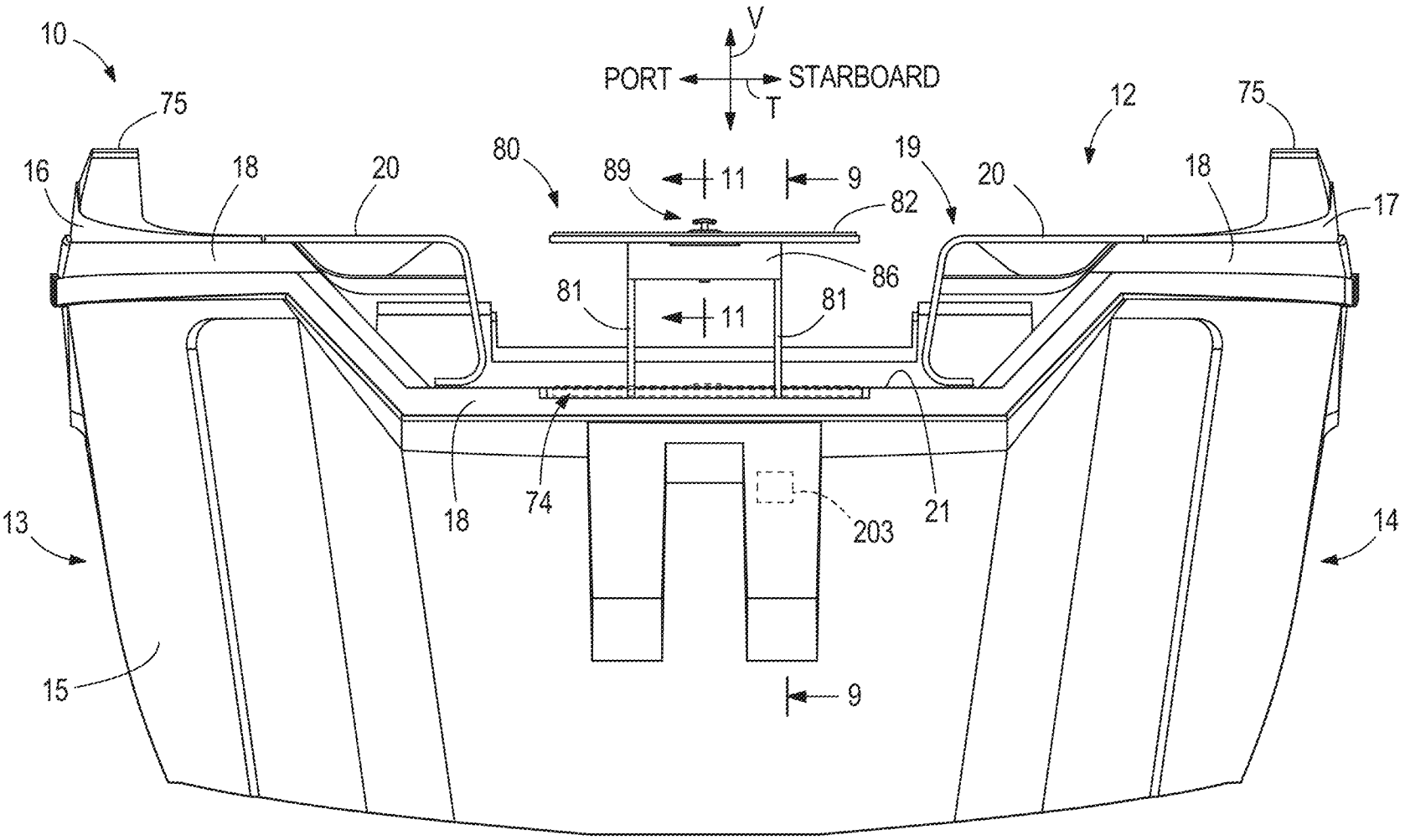
FIG. 7 is an end view of a stern of an example marine vessel according to the present disclosure.

As depicted in FIG. 7 (and FIG. 1), the gate 80 is mounted to the stern 12 of the marine vessel 10. Note that while the gate 80 is described herein with respect to the stern 12, the gate 80 can be mounted to any portion of the marine vessel 10 such as the port side 13, the starboard side 14, and/or the bow 22. Further note that depending on the specific construction of the marine vessel 10, the gate 80 can be mounted to the hull 15, the deck 21, one of the sidewalls 16, 17, 18, a gun whale 75, and/or any other component of the marine vessel 10.

The gate 80 is movable into an extended position (see solid lines in FIG. 7) in which the gate 80 extends vertically (see example vertical axis V in FIG. 7) upwardly from the stern sidewall 18 and a retracted position (see dashed lines in FIG. 7) in which the gate 80 is recessed into the cavity 29. In another example, the gate 80 in the retracted position extends along the exterior surface of the stern sidewall 18.

The gate 80 has a pair of vertically extending legs 81 and a top rail 82 which is coupled to the legs 81. The top rail 82 laterally extends (see example lateral axis T in FIG. 7), and the top rail 82 is received into a recess 74 defined in the stern sidewall 18, the deck 21, and/or a gun whale 75.

Figure 8:
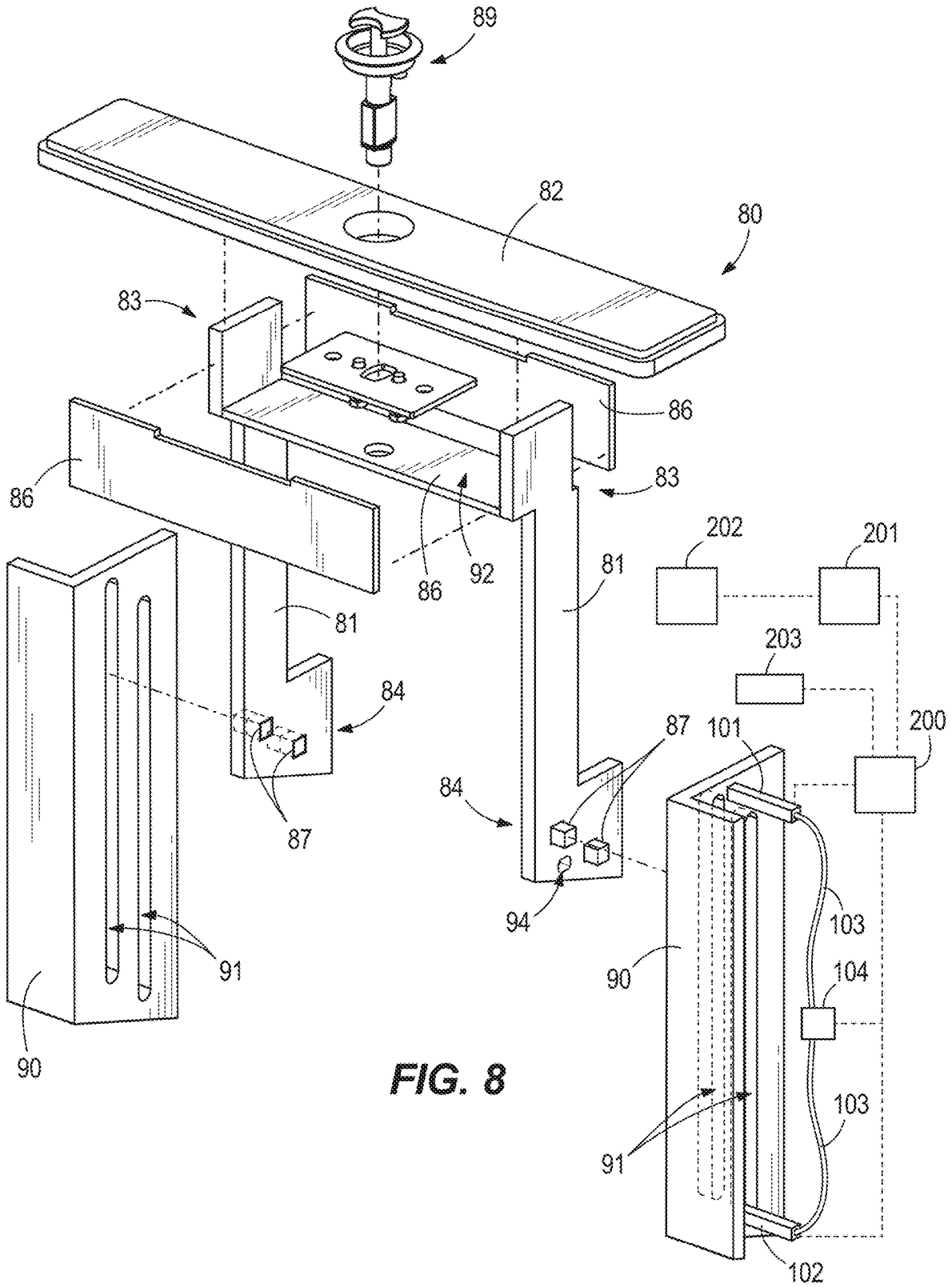
FIG. 8 is an exploded view of an example gate according to the present disclosure.

FIG. 8 depicts the gate 80 in greater detail. The legs 81 have a first leg end 83 and an opposite second leg end 84. The first leg ends 83 are coupled to each other with a plurality of crossbars 86 (note that two of the crossbars 86 depicted in FIG. 8 are spaced apart from the legs 81 for clarity. The first leg ends 83 are coupled to the top rail 82.

Figure 11:
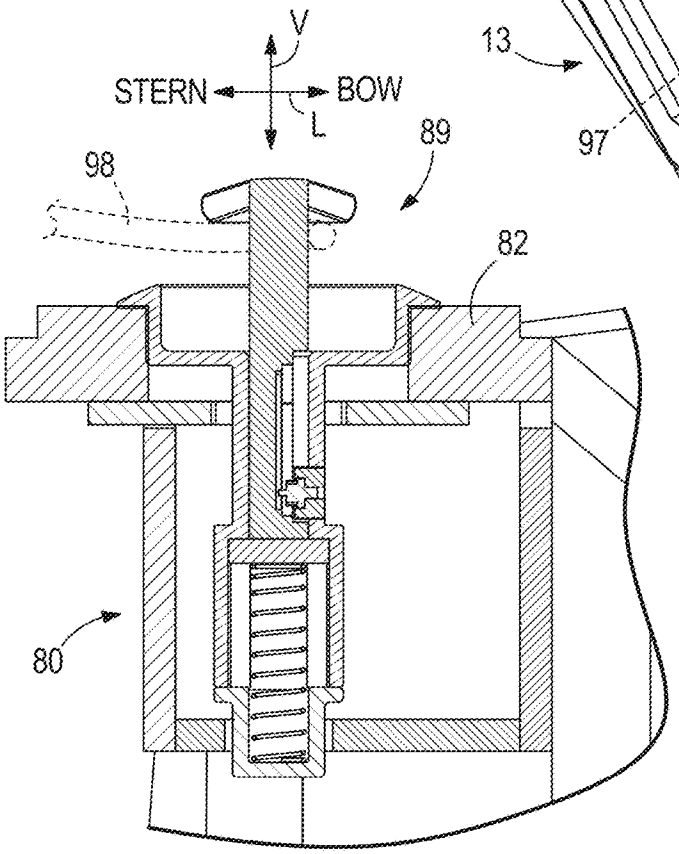
FIG. 11 is an enlarged view of an example toe line latch coupled to an example gate according to the present disclosure.

A pop-up ski tow device or tow line latch 89 (see also FIG. 11) is coupled to the top rail 82, and the latch 89 extends into a chamber 92 defined by the crossbars 86. FIG. 11 depicts an example latch 89, and the latch 89 is operatable into and between an up position in which the latch 89 extends above top rail 82 and a recessed position in which the latch 89 is recessed below the top rail 82. An example of a commercially available latch 89 is commercially available from WhiteCap Marine Products (part #6957, 6957c). The latch 89 in the up position is for connection to a toe line 98 (dashed lines).

One or more pins 87 are coupled to the second leg ends 84. The pins 87 laterally extend outwardly from the second leg end 84 and are received into slots 91 (e.g., vertically elongated slots 91). The slots 91 guide the pins 87 and thereby movement of the gate 80 (described in greater detail therein). In certain examples, the slots 91 are defined in the hull 15 and/or the stern sidewall 18 (FIG. 7). In other examples, such as the example depicted in FIGS. 8-10, the slots 91 are defined in brackets 90 which are mounted to the hull 15. The pins 87 can be any suitable shape and/or size, and in the example depicted in FIG. 8, the pins 87 each have a square shape. In certain examples, the pins 87 on each leg 81 are vertically offset from each other.

At least one of the second leg ends 84 also defines a hole 94 that is configured to selectively receive a locking member of one or more locks 101, 102. The locks 101, 102 as will be described herein below, are configured to selectively retain or lock the gate 80 in the extended position and/or the retracted position. The type of lock 101, 102 can vary, and in one non-limiting example, the locks 101, 102 include spring-biased pins that are configured to selectively extend and/or retract.

The locks 101, 102 are actuated by any suitable device or actuator. In one non-limiting example, the locks 101, 102 are coupled via one or more cables 103 to an actuator 104. The type of actuator 104 can vary and may include a mechanical push button, pressure pad, or toggle switch. The actuator 104 can be located at any location on the marine vessel 10 (e.g., mounted on the gun whale 75, the deck 21, or the helm). In one example, as will be described hereinbelow, the operator presses the actuator 104 such that the cables 103 apply a pulling force on the locks 101, 102 which withdraws or retracts a lock member (not depicted; e.g., lock pin) of the locks 101, 102. As such, the lock member is not received in the hole 94 in the leg 81 and the gate 80 is movable into and between the extended position and the retracted position. The operator then releases the actuator 104 and the lock members of the locks 101, 102 extend. Once one of the lock members is aligned the hole 94, the aligned lock member extends into the hole 94 thereby locking the gate 80 in the corresponding position (e.g., extended position or retracted position).

Figure 9:
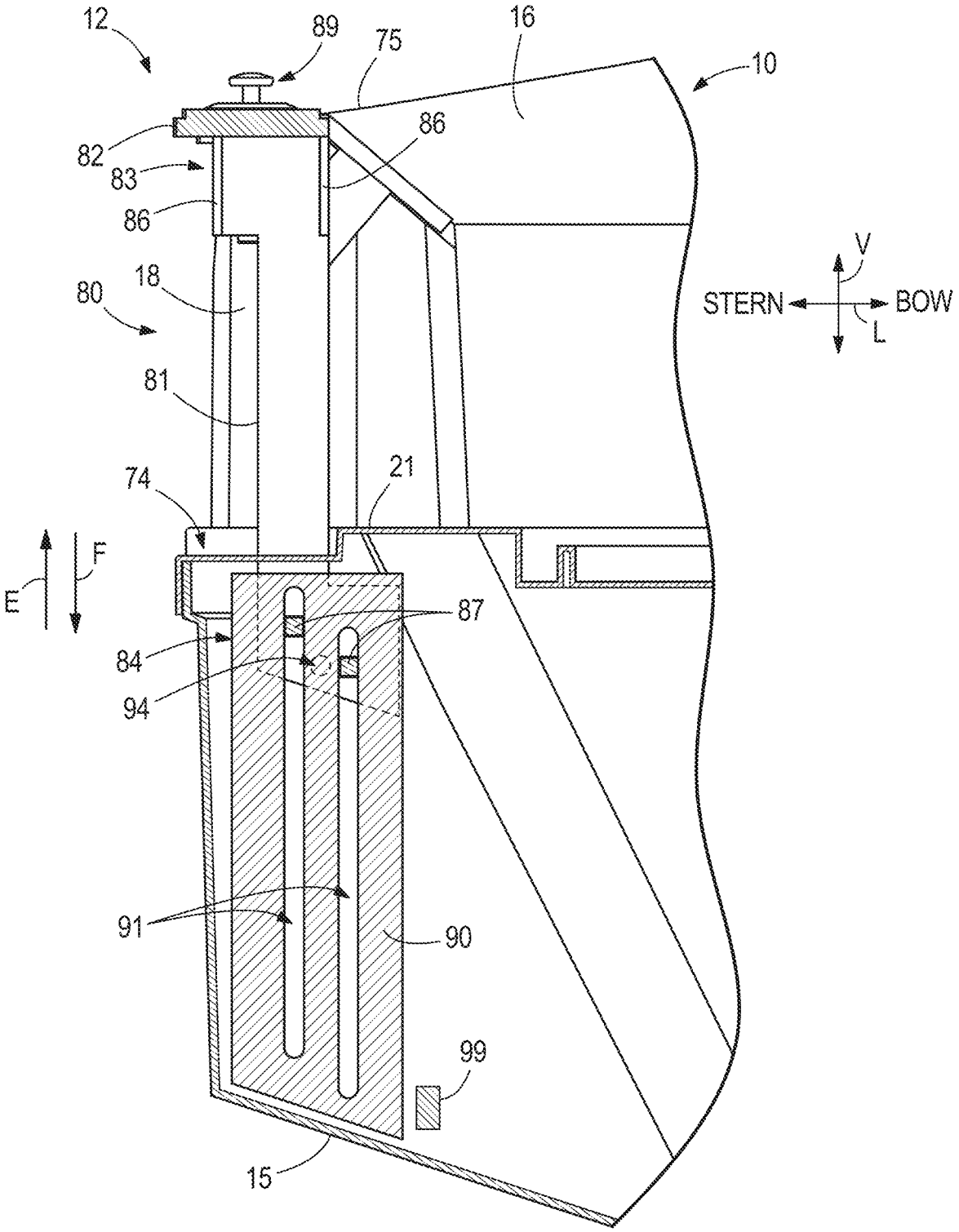
FIG. 9 is a cross-sectional view of the marine vessel of FIG. 7 along line 9-9 in FIG. 7 with the gate in an extended position.
Figure 10:
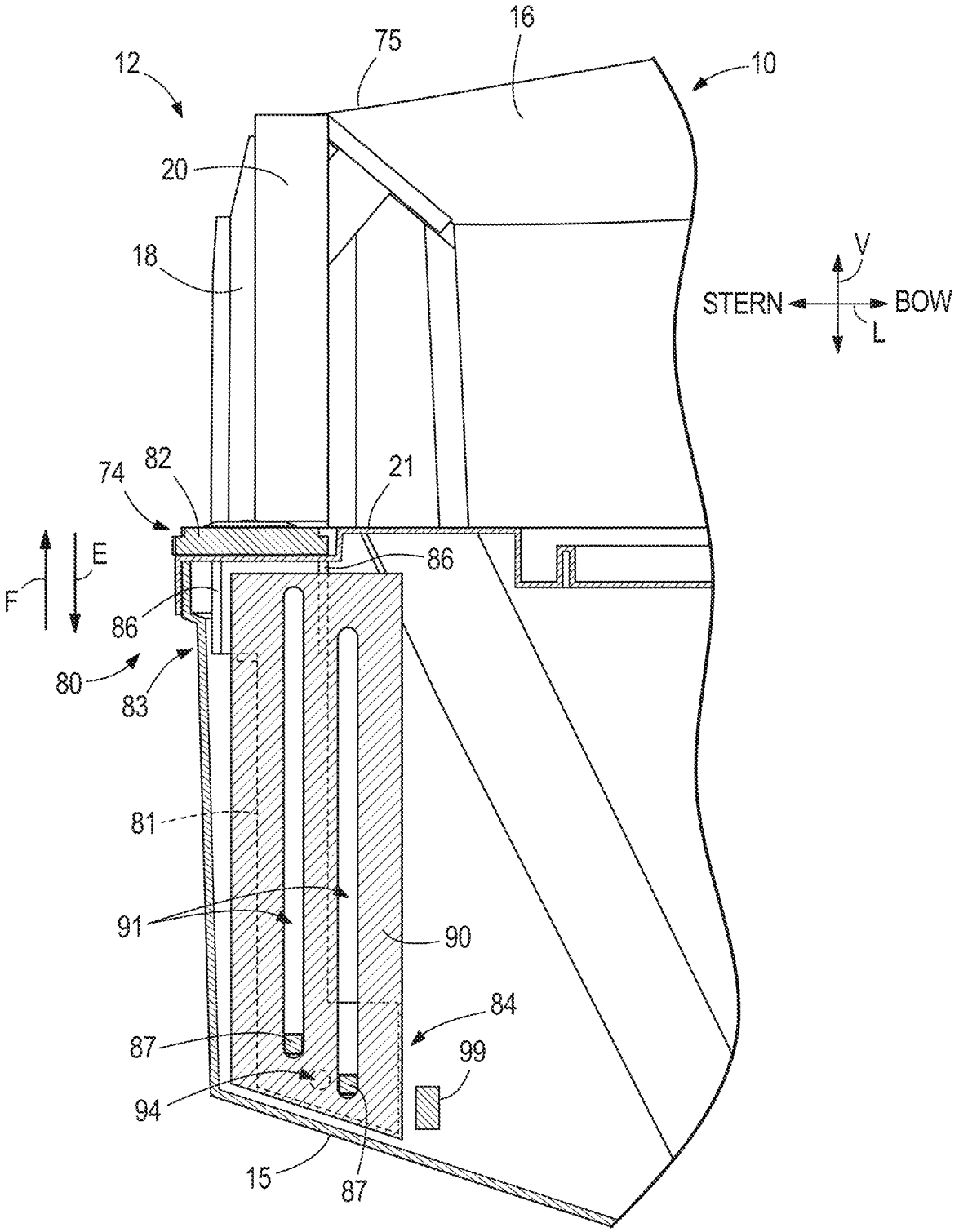
FIG. 10 is a cross-sectional view of the marine vessel of FIG. 7 along line 9-9 in FIG. 7 with the gate in a retracted position.

Referring now to FIGS. 9-10, the gate 80 is depicted in the extended position (FIG. 9) and the retracted position (FIG. 10), and an example operational sequence of the board storage system 50 is described herein below.

FIG. 9 depicts the gate 80 in the extended position. In this position, the lock member of the first lock 101 (FIG. 8) extends into the hole 94 such that the gate 80 is locked in the extended position. To move the gate 80 to the retracted position (FIG. 10), the operator engages the actuator 104 such that the lock member of the first lock 101 retracts and is no longer received into the hole 94. As such, the gate 80 may vertically slide toward the retracted position. The gate 80 may be vertically moved by force of gravity and/or forces applied by the operator such as pushing forces (see arrow E in FIG. 9). In certain examples, an assist device 99 (schematically depicted in FIGS. 9-10) such as a gas spring, a spring (e.g., compression spring), a gas piston, or other suitable device may prevent the gate 80 from free falling and/or uncontrollably moving toward the retracted position and thereby prevents the operator fingers or toes from being pinched between the top rail 82 and the deck 21 or gun whale 75. In certain examples, the assist device 99 may be configured to slightly move the gate 80 out of the stowed position such that the operator can grasp and lift the gate 80.

The movement of the gate 80 toward the retracted position (FIG. 10) is guided by the pins 87 sliding in the slots 91. As the gate 80 begins to move toward the retracted position, the operator releases the actuator 104 and the lock members extend from the locks 101, 102. The lock members and slide along the surface of the leg 81 as the gate 80 moves toward the retracted position. Once the lock member of the second lock 102 is aligned with the hole 94, the aligned lock member extends into the hole 94 thereby locking the gate 80 into the retracted position, as depicted in FIG. 10.

To move the gate 80 to the extended position (FIG. 10), the operator engages the actuator 104 such that the lock member of the second lock 102 retracts and is no longer received in the hole 94. As such, the gate 80 can be vertically slid toward the extended position (FIG. 9). The gate 80 may be vertically moved by forces applied by the operator such as pulling forces (see arrow F in FIG. 10). In certain examples, the assist device noted above or another assist device, such as a compression spring or a gas piston, is configured to assist movement of the gate from the retracted position toward the extended position. As the gate 80 is moved toward the extended position, the operator releases the actuator 104 and the lock members extend from the locks 101, 102. Once the lock member of the first lock 101 is aligned with the hole 94, the lock member extends into the hole 94 thereby locking the gate 80 into the extended position, as depicted in FIG. 9.

In certain examples, the actuator 104 and/or the locks 101, 102 are coupled to a control system 200 (see FIG. 8) of the marine vessel 10 which controls operation of the marine vessel 10. The actuator 104, the locks 101, 102, and/or switches or sensors 203 (e.g., limit switches, Hall-Effect sensors, proximity sensors) can provide electronic signals to the control system 200 corresponding to the state (e.g., locked or unlocked) and/or position (e.g., extended position or retracted position) of the gate 80. The control system 200 may control operation of one or more associated components (e.g., a marine drive 201 such as an outboard motor) based on the signals received. In one instance, if the control system 200 receives signals from the actuator 104, the locks 101, 102, and/or sensors 203 indicative of the gate 80 being in the retracted position (FIG. 10), the control system 200 prevents the marine drive 201 from propelling the marine vessel 10 or propelling the marine vessel 10 above a predetermined speed (e.g., 5.0 miles per hour) as a safety precaution. The operator of the marine vessel 10 could move the gate 80 into the extended position (FIG. 9) such the control system 200 would allow for faster propulsion of the marine vessel 10. The control system 200 could additionally or alternatively provide a visual or audio alert to the operator via a user interface device 202 such as a control panel, LED light, or touchscreen display that the gate 80 is in the retracted position.

Figure 12:
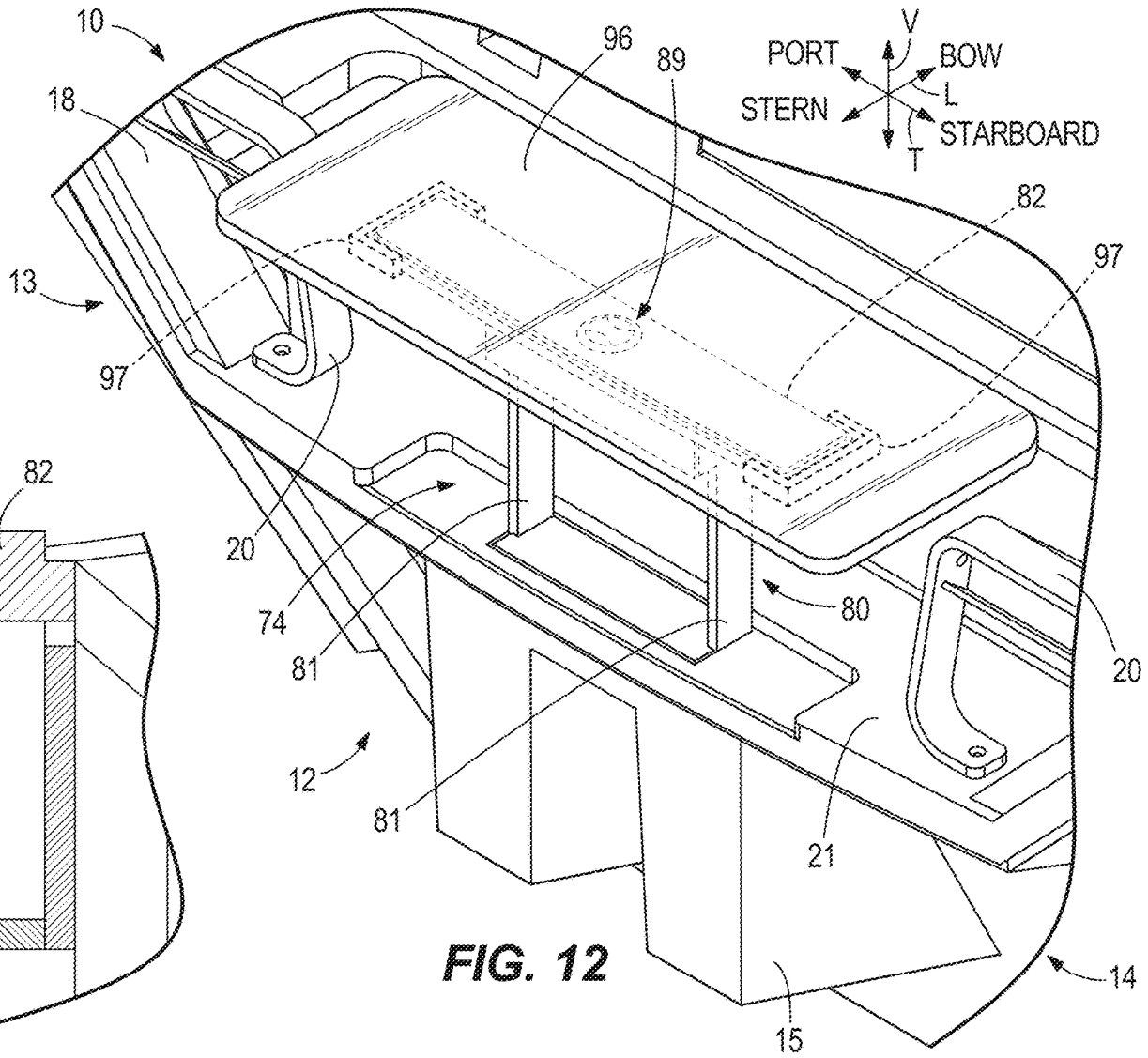
FIG. 12 is a perspective view of a stern of an example marine vessel according to the present disclosure.

FIG. 12 depicted the gate 80 in the extended position and the latch 89 in a retracted position such that an example table 96 according to the present disclosure is coupled to the top rail 82. The table 96 provided the occupants of the marine vessel 10 a location to place items such as beverage containers, fishing equipment, and/or the like. The table 96 may also be used to clean fish. The table 96 has a pair of u-shaped brackets 97 along the underside that engage with the perimeter of the top rail 82 to prevent the table 96 from inadvertently moving off the top rail 82.

Referring now to FIGS. 13-16, the example seat 300 briefly described above is described in further detail.

The seat 300 is supported on the frame 28, and the seat 300 has a seat bottom 303 which is fixed in place relative to the frame 28. The seat bottom 303 can include one or more cushions 304 which may be removable for cleaning and/or replacement. The seat bottom also defines one or more cutouts 305 (described further herein).

Figure 16:
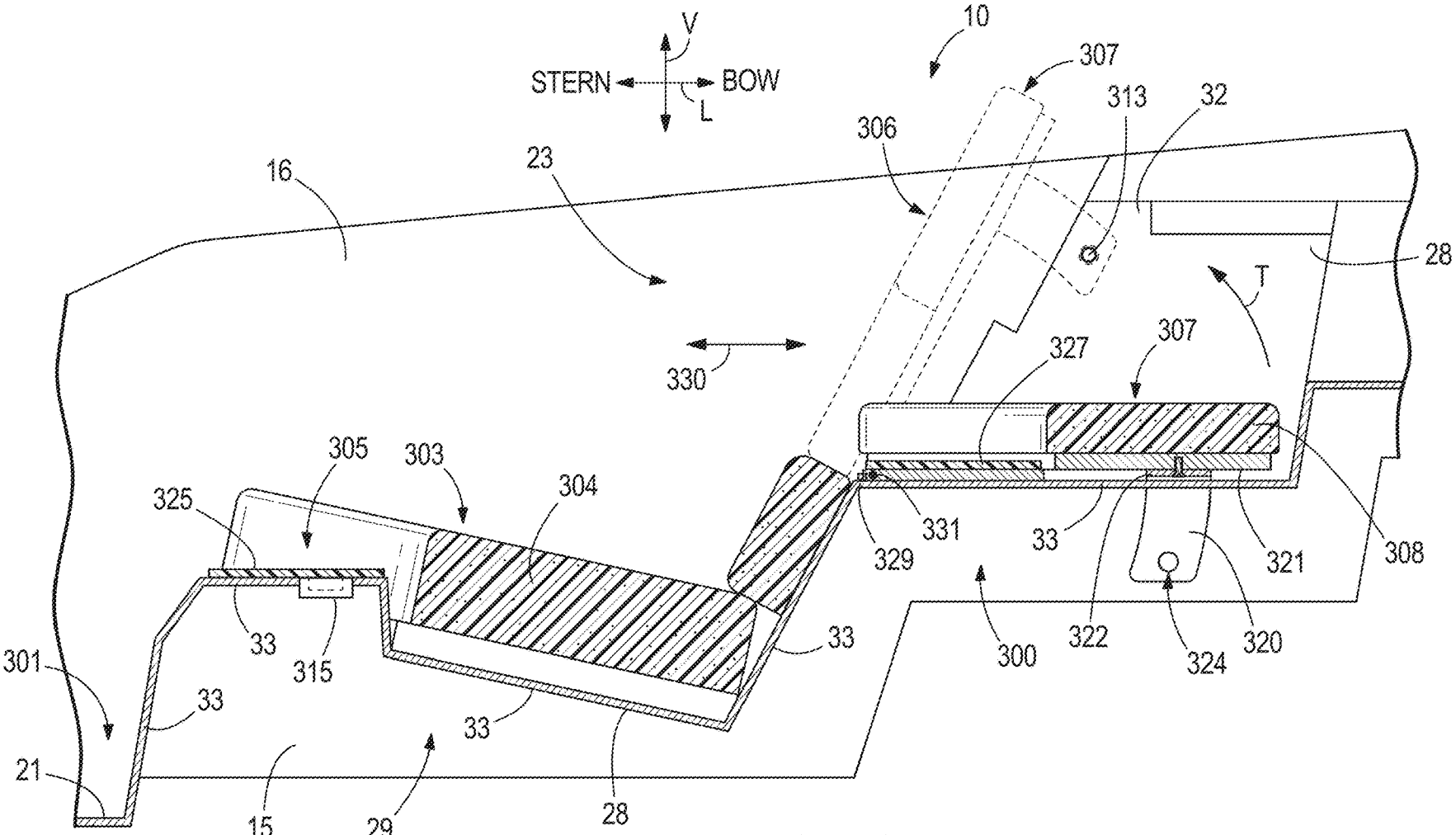
FIG. 16 is a cross-sectional view of the seat system depicted in FIG. 15 along line 16-16 in FIG. 15. The seat in the lowered position is depicted in solid lines and the seat in the raised position is depicted in dashed lines.

The seat 300 has a seat back 307 which is movably coupled to the frame 28. For example, one or more hinges 329 pivotably couple the seat back 307 to the frame 28 such that the seat back 307 pivots about a pivot axis 331 (FIG. 16). The seat back 307 can include one or more cushions 308 which may be removable for cleaning and/or replacement. The seat back 307 also defines one or more cutouts 309 (described further herein).

Figure 14:
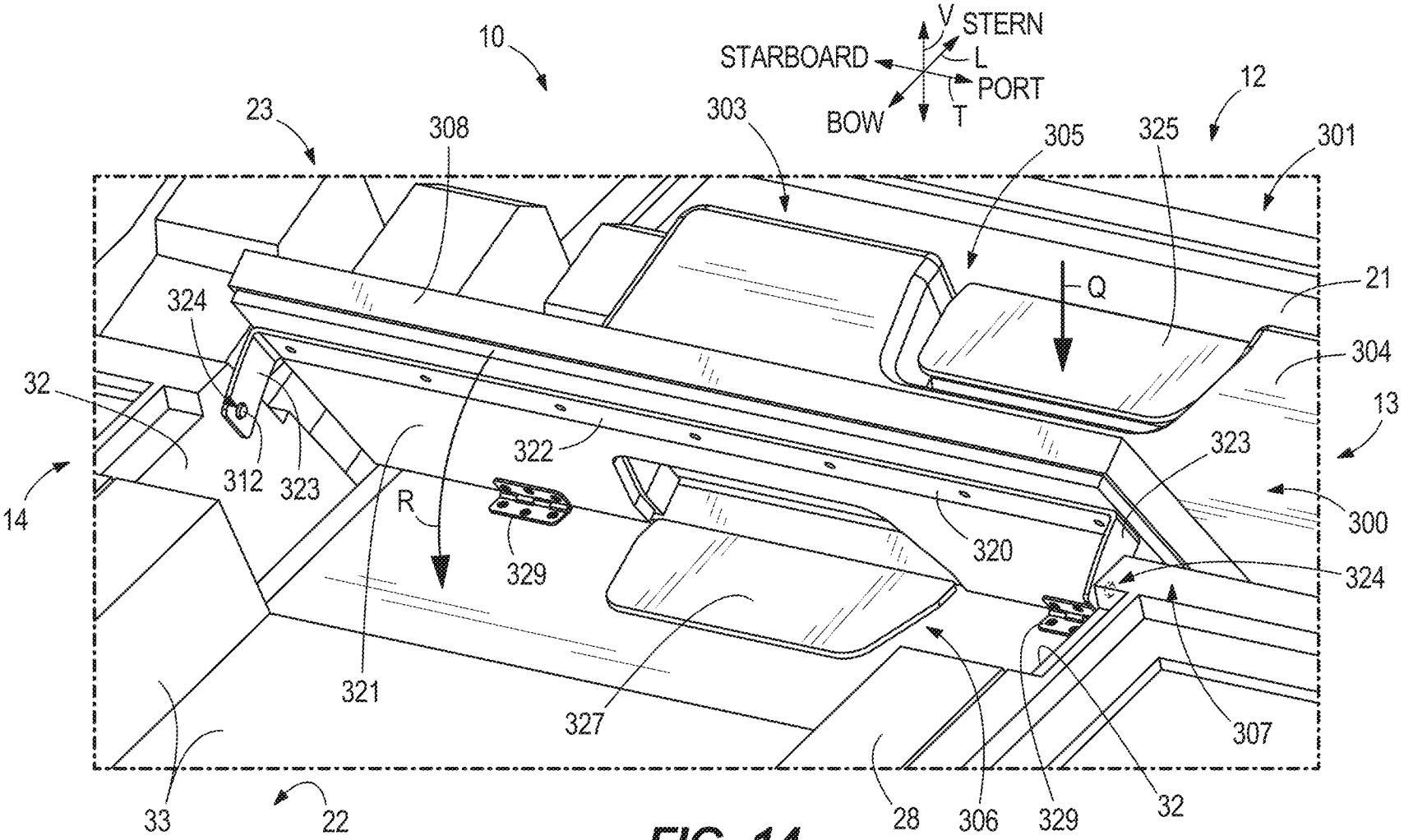
FIG. 14 is a perspective view of the seat system of FIG. 13 with the seat in the raised position.
Figure 15:
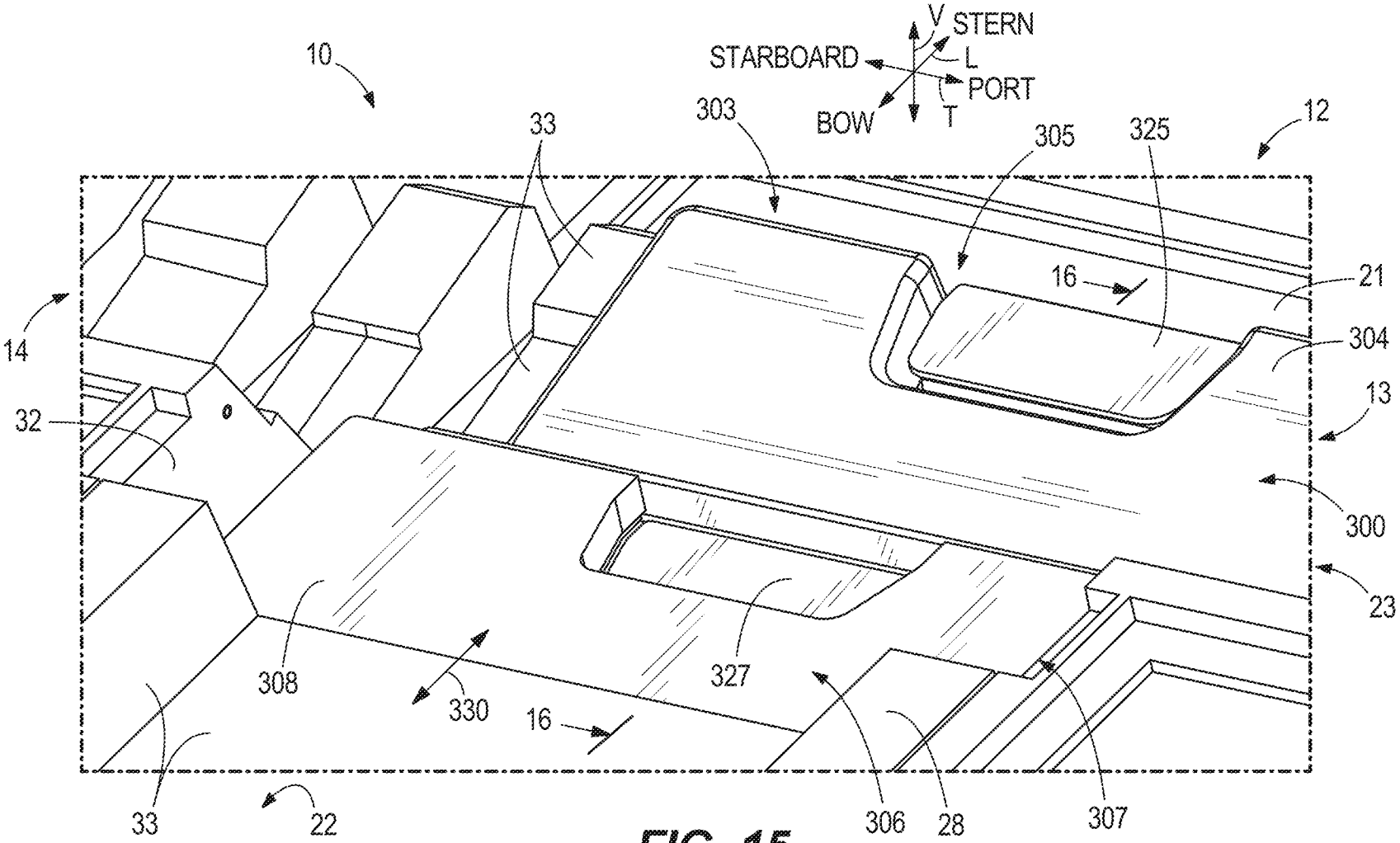
FIG. 15 is a perspective view like FIG. 14 with the seat in a lowered position.

The seat back 307 is movable into and between a raised position (FIGS. 13-14) and a lowered position (FIG. 15). In the raised position, the seat back 307 is rear or stern facing, is configured to support occupants of the marine vessel 10 thereon, and/or prevents movement of the occupants across the seat system 23 and through a passageway 306 defined by the frame 28. In the lowered position, the seat back 307 lies along the frame 28 (e.g., the seat back 307 generally lies horizontally along the frame 28) thereby permitting the occupants of the marine vessel 10 to move across the seat system 23. When the seat 300 is in the raised position, the seat 300 prevents movement of the occupants across the seat system 23 between the section of deck 21 located between the seating system 23 and the stern sidewall 18 (denoted by part number 301 in FIGS. 1 and 13; this section of the deck 21 may be referred to a gallery section) and the section of deck 21 located between the seating system 23 and the bow 22 (denoted by part number 302 FIGS. 1 and 13).

The seat back 307 includes a bracket 320 coupled to a rear surface 321 of the seat back 307 which is opposite the cushions 308. The bracket 320 has a body 322 that extends along the rear surface 321 and a pair of opposing arms 323 that extend away from the rear surface 321. Each arm 323 has a hole 324 defined therein.

The seat 300 also includes one or more locks 312, 313 for selectively locking the seat back 307 in the raised position (FIGS. 13-14) and configured to be actuated such that the seat back 307 and can be moved into the lowered position (FIG. 15). The type of lock 312, 313 can vary, and in one example, the locks 312, 313 include spring-biased pins that are configured to selectively extend and/or retract.

The locks 312, 313 are mounted to sidewalls panels 32 of the frame 28 and located within the cavity 29. The locks 312, 313 are located adjacent opposite sides of the seat back 307. The sidewall panels 32 at least partially define the passageway 306, At least a portion of the locks 312, 313, such as lock members (e.g., pins) extend through holes in the sidewall panels 32 into the passageway 306. Note that the frame 28 can include one or more panels 33 that support the seat bottom 303 and/or the seat back 307 and divide the deck 21.

The locks 312, 313 are actuated by any suitable device or actuator 315 of the seat 300 such as a mechanical and/or electromechanical pressure pad, a spring piston, a pneumatic piston, strain gauges, and the like. In one non-limiting example, the actuator 315 is a mechanical pressure pad which is coupled to the locks 312, 313 are coupled via one or more cables 314. When the pressure pad is depressed, the cables 314 to act on the locks 312, 313 such that the spring-pins of the locks 312, 312 retract and out of the passageway 306. Note that in other examples, the actuator 315 is coupled to the locks 312, 313 are wires such that electronic command signals (e.g., signals that cause the locks 312, 313 to unlock from the seat back 307 can be sent between the actuator 315 and the locks 312, 313.

The location of the actuator 315 on the marine vessel can vary, and in the example depicted the actuator 315 is positioned vertically below a step 325 of the seat 300 which is movably mounted on the deck 21 or the frame 28. The step 325 is located in the cutout 305 of the seat bottom 303. When the step 325 is engaged (e.g., depressed), the actuator 315 is actuated. In one specific example, an occupant of the marine vessel 10 steps on the step 325 thereby depressing the step and depressing the actuator 315. Note that the actuator 315 is located to avoid damage or operating inefficiencies caused when water and/or debris damage the actuator 315. Note that the step 325 can have slip-resistant material applied thereto.

In other examples, the actuator 315 is alternatively positioned vertically below a second step 327 which is also movably mounted on the frame 28. The second step 327 is located such that when the seat back 307 is in the lowered position, the second step 327 is in the cutout 309 of the seat back 307 (see FIG. 15)

In other examples, the actuator 315 is operably coupled to the step 325 (described above) is a first actuator 315 and a second actuator (not depicted) is positioned vertically below the second step 327 (described above). In these examples, the first actuator 315 and the second actuator are connected via the cables 314 to the locks 312, 313 such that actuation of the first actuator 315 and/or the second actuator unlocks the seat back 307.

In other examples, the actuator 315 is operably coupled the step 325 (described above) is also operably coupled with the second step 327 (described above) such that stepping on either the first step 325 or the second step 327 causes the actuator 315 to unlock the seat back 307. For instance, the actuator 315 is coupled to a second step 327 by a wire or cable and thus depressing the second step 327 or the first step 325 actuates the actuator 315. As such, one actuator 315 can be utilized with a plurality of steps 325.

Figure 13:
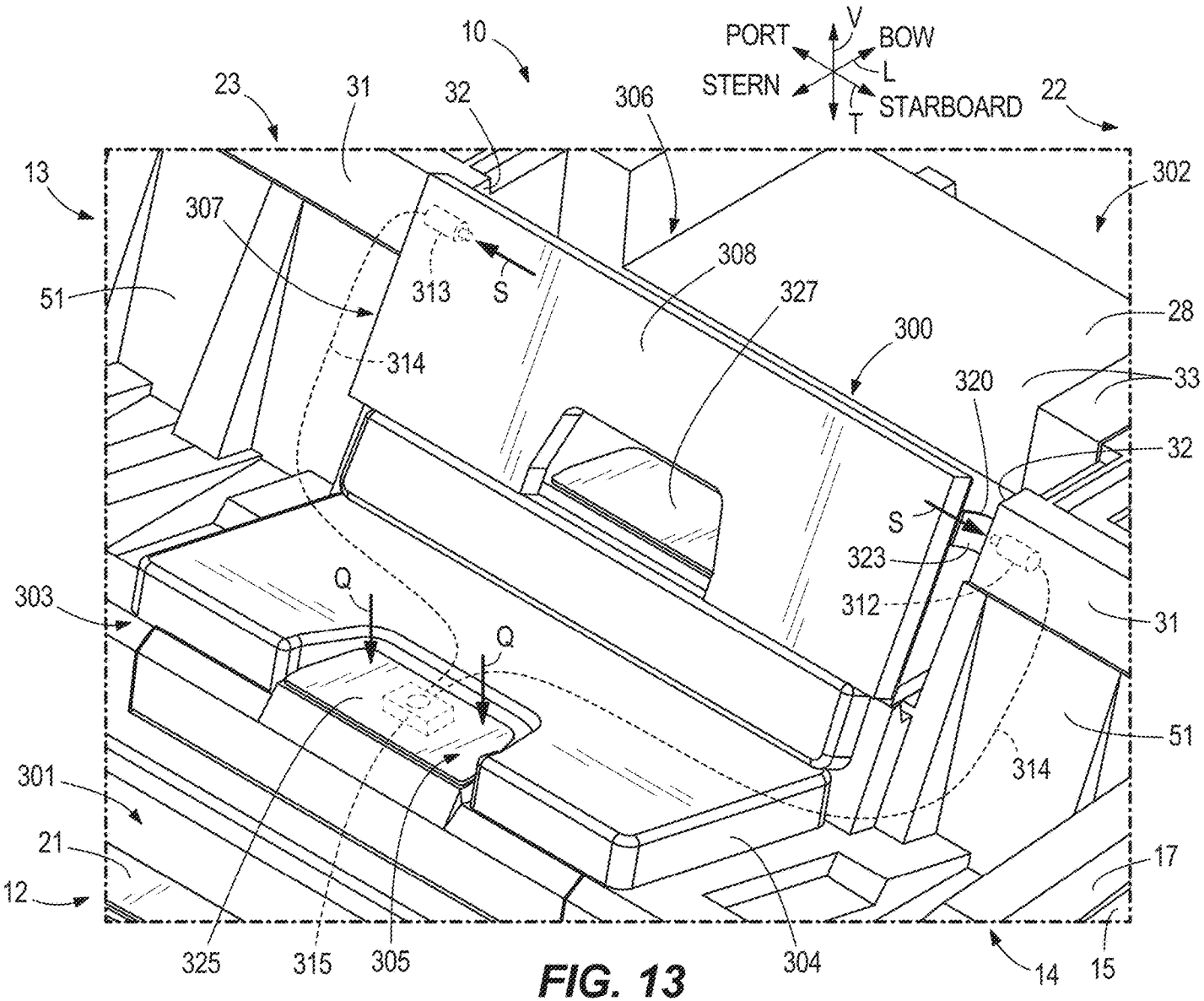
FIG. 13 is a perspective view of an example seat system according to the present disclosure with a seat in a raised position.

An example operational sequence of the seat 300 is described herein below. FIGS. 13-14 depict the seat back 307 in the raised position. The locks 312, 313 engage with the bracket 320 such that the seat back 307 is retained or locked in the raised position. In one specific example, lock members of the lock 312, 313 extend into the holes 324 defined in the arms 323 of the bracket 320 such that the seat back 307 is locked in the raised position.

When an operator desires to move the seat back 307 in the lowered position (FIG. 15), the occupant engages (e.g., depresses) the step 325 (see arrows Q in FIGS. 13-14) thereby actuating the actuator 315. The actuator 315 acts on the cable 314 which acts on the locks 312, 313 such that the locks 312, 312 unlock the seat back 307 and the seat back 307 can be moved (see arrow R in FIG. 14) into the lowered position (by force of gravity or pushing force applied by the occupant). The operator can now walk over the seat 300, the seat system 23, and the frame 28 and through the passageway 306. In one specific example, depressing the step 325 causes actuates the actuator 315 such that the actuator 315 applies a pulling or pushing force on the cables 314. The pulling or pushing force acting on cables 314 causes the cables 314 to act on the locks 312, 313 thereby retracting the lock members (see arrows S in FIG. 13) from the hole 324 in the bracket 320.

The operator then releases or steps off the step 325 such that the step 325 returns to its original position and the actuator 315 no longer acts on the cables 314. The locks 312, 313 return to their original position (e.g., the lock members of the locks 312, 313 extend through the sidewall panels 32. The seat back 307 extends along a panel 33 of the frame (see FIG. 16), and the arms 323 are received into the cavity 29 or a pocket defined by the frame 28 (see FIG. 16).

Note that when the gate 80 is in the retracted position (FIG. 10) and the seat back 307 is in the lowered position (FIG. 15) provides a walkway 330 from the stern 12 past the seat 300 and/or seat assembly 23 towards the bow 22.

When the operator desires to move the seat back 307 back to the raised position (FIGS. 13-14), the operator applies a lifting or pulling force (see arrow T in FIG. 16) to the seat back 307. As the seat back 307 is moved toward the raised position, the arms 323 act on the locks 312, 313 (e.g., angled or sloped perimeter surface of the arms 323 depress lock members of the locks 312, 313) such that the locks 312, 313 slide along the arms 323 until the locks 312, 313 lock the seat back 307 into the raised position. In one example, a surface, such as perimeter surface of the arms 323, at least partially depresses the lock members of the locks 312, 313 until the lock members are aligned with the holes 324. The lock members being biased by springs in the locks 312, 313 to extend into the holes 324 when aligned with the holes 324 thereby locking the seat back 307 in the raised position.

In certain examples, an assist device (not depicted) such as a spring, a gas piston, or other suitable device may be coupled to the seat back 307 to free falling and/or uncontrollably moving toward the lowered position thereby preventing the operator fingers or toes from being pinched between the seat back 307 and the frame 28. The assist device may be alternatively or additionally configured to apply forces to the seat back 307 which assist movement of the gate from the lowered position toward the raised position.

In certain independent examples, a marine vessel includes a hatch permitting access into a cavity, a cover on the hatch, the cover being movable into an open position to open the hatch and a closed position to close the hatch, and shelving that defines slots for storing boards. The shelving being moved into an extended position when the cover is moved into the open position, the extended position facilitating insertion of boards into the slots, and the shelving being moved into a collapsed position when the cover is moved into the closed position, the collapsed position facilitating storage of the boards in the cavity.

Optionally, moving the cover into the closed position collapses the shelving and brings the boards closer together. Optionally, the shelving comprises a flexible material that collapses upon closing of the cover. Optionally, the shelving comprises a canvas material. Optionally, the slots are arranged in a stack, each slot having an open end for receiving one of the boards and a closed end opposite the open end. The open ends are collapsed upon moving the cover into the closed position. Optionally, an end wall defines the closed end of each slot. Optionally, the shelving includes shelves which collapse towards each other when the cover is moved into the closed position. Optionally, the shelving includes a flexible support member on each side of the shelving, the flexible support members being coupled to the cover and each of the shelves. Optionally, each shelf is coupled to and spaced apart along the flexible support members. Optionally, the flexible support members are located closer to the open end than the closed end. Optionally, the flexible support members are a first pair of flexible support members having a flexible support member located on each side of the shelving, and further comprising a second pair of flexible support members having a flexible support member located on each side of the shelving. Optionally, the cover is provided by a seat for the marine vessel. Optionally, the seat includes a seat back and a seat bottom which are transversely oriented relative to each other. Optionally, the shelving comprises a flexible material coupled to the cover and configured to move with the cover. Optionally, the cover is pivotable into and between the open position and the closed position. Optionally, a gas spring is for assisting movement of the cover toward at least one of the open position and the closed position. Optionally, a latch retains the cover in the closed position and is operable to permit movement of the cover into the open position. Optionally, the hatch faces a stern of the marine vessel. Optionally, the cover is provided by a seat of the marine vessel, and wherein the seat includes a seat bottom and a seat back, the seat back facing the stern when the cover is in the closed position. Optionally, the marine vessel includes a deck and a hull, the cavity being at least partially defined between the deck and the hull.

In certain independent examples, a marine vessel includes a sidewall and a cavity and a gate movable into and between an extended position in which the gate extends upwardly from the sidewall and a retracted position in which the gate is recessed into the cavity.

Optionally, the gate is slidable into and between the extended position and the retracted position. Optionally, marine vessel has a hull at least partially defines the cavity in which the gate is received. Optionally, the marine vessel has a hull to which the gate is mounted. Optionally, marine vessel has a stern and the sidewall is located at the stern. Optionally, a toe line latch that is coupled to and moveable with the gate and for retaining a toe line. Optionally, the toe line latch is movable into and between an up position for connection to the toe line and a down position within the gate. Optionally, the gate includes a pair of legs having one or more pins which extend into slots. Optionally, the slots are defined by one or more brackets. Optionally, each leg in the pair of legs has two pins extending therefrom and the pins on each leg are vertically offset from each other. Optionally, the gate includes a pair of legs and a top rail extending between the legs. Optionally, when the gate is in the retracted position the top rail is in a recess. Optionally, a first lock locks the gate in the extended position. Optionally, a second lock locks the gate in the retracted position. Optionally, an actuator is configured to be engaged such that the first lock unlocks the gate. Optionally, a spring prevents the gate from free falling into the retracted position. Optionally, the marine vessel includes a marine drive and a user interface device, the user interface device configured to alert an occupant when the gate is in the retracted position and the marine drive is engaged to propel the marine vessel in water.

In certain independent examples, a marine vessel includes a hull comprising a bow, an opposite stern, and a sidewall, the hull further at least partially defining a cavity therein. A gate is located at the stern, the gate is movable into an extended position in which the gate extends upwardly from the sidewall and into a retracted position in which the gate is withdrawn into the cavity. A seat including a seat bottom and a seat back such that the seat back is movable into and between a raised position in which the seat back provides a backrest for an occupant sitting on the seat bottom and a lowered position permitting the occupant to walk over the seat from a deck.

Optionally, a lock is for locking the seat back in the raised position and unlocking from the seat back such that the seat back can be moved into the lowered position and a step is configured to actuate an actuator such that stepping on the step causes the actuator to unlock the lock. Optionally, moving the gate to the retracted position and moving the seat back in the lowered position provides a walkway from the stern past the seat towards the bow. Optionally, the step is one of a first step and a second step configured to enabling the occupant to walk up and then over the seat. Optionally, a platform is located behind the stern, and a gallery section located between the stern and the seat, such that moving the gate in the retracted position and moving the seat back into the lowered position permits the occupant to walk from the platform over the gate onto the gallery section, and from the gallery section onto a step which facilitates moving of the seat back into the lowered position, enabling the occupant to then walk over the seat to a forward portion of the marine vessel.

In certain independent examples, a seat for a marine vessel includes seat bottom, a seat back that is movable into a raised position providing a backrest for an occupant sitting on the seat bottom and alternately into a lowered position permitting the occupant to walk over the seat, a lock for selectively locking the seat back in the raised position and unlocking from the seat back such that the seat back can be moved into the lowered position, and a step configured such that stepping on the step unlocks the lock from the seat back.

Optionally, an actuator causes the lock to unlock from the seat back when stepping on the step. Optionally, the step is located in a cutout defined by the seat bottom. Optionally, the step is located in a cutout defined by the seat back when the seat back is in the lowered position. Optionally, the step is located below the seat back when the seat back is in the raised position. Optionally, the step is a first step and a second step is provided, wherein stepping on the first step or the second step unlocks the lock from the seat back. Optionally, a first actuator is operably coupled to the first step that causes the lock to unlock from the seat back when stepping on the first step and a second actuator is operably coupled with the second step that causes the lock to unlock from the seat back when stepping on the second step. Optionally, the first step being positioned lower than the second step enabling the occupant to walk up and then over the seat. Optionally, the first step is positioned in a cutout in the seat bottom and the second step being positioned in a cutout in the seat back when in the lowered position. Optionally, the lock includes a lock member that engages the seat back in the raised position and further comprising a cable that operably couples the step to the lock such that stepping on the step unlocks the lock from the seat back. Optionally, the lock is a first lock and further comprising a second lock, and the first lock and the second lock are located adjacent opposite sides of the seat back. Optionally, a cable that operably couples the step to the first lock and the second lock such that stepping on the step unlocks the first lock and the second lock from the seat back. Optionally, the step is a first step and a second step is provided, wherein stepping on the first step or the second step unlocks the first lock and the second lock from the seat back. Optionally, a first actuator is operably coupled to the first step that causes the first lock and the second lock to unlock from the seat back when stepping on the first step and a second actuator is operably coupled to the second step that causes the first lock and the second lock to unlock from the seat back when stepping on the second step.

In certain independent examples, a marine vessel includes a deck, a seat including a seat bottom and a seat back, the seat back is movable into a raised position providing a backrest for an occupant sitting on the seat bottom and alternately into a lowered position permitting the occupant to walk over the seat from the deck, a lock for selectively locking the seat back in the raised position and unlocking from the seat back such that the seat back can be moved into the lowered position, and a step configured such that stepping on the step unlocks the lock from the seat back.

Optionally, the marine vessel includes a bow and a stern. The deck has a gallery section located between the seat and the stern, and the seat permits the occupant to walk from the gallery section onto the step which facilitates lowering of the seat back into the lowered position and thereby permits an occupant to then walk over the seat toward the bow. Optionally, the step is located in a cutout defined by the seat bottom. Optionally, the step is located in a cutout defined by the seat back when the seat back is in the lowered position. Optionally, the step is a first step and a second step is provided, wherein stepping on the first step or the second step unlocks the lock from the seat back. Optionally, the first step is positioned lower than the second step enabling the occupant to walk up and then over the seat. Optionally, moving the seat back to the lowered position provides a walkway from the stern past the seat towards the bow.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

This written description uses examples to disclose the invention and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A marine vessel comprising:

a hatch permitting access into a cavity;

a cover on the hatch, the cover being movable into an open position to open the hatch and a closed position to close the hatch; and shelving that defines slots for storing boards, the shelving being moved into an extended position when the cover is moved into the open position, the extended position facilitating insertion of boards into the slots, and the shelving being moved into a collapsed position when the cover is moved into the closed position, the collapsed position facilitating storage of the boards in the cavity.

2. The marine vessel according to claim 1, wherein moving the cover into the closed position collapses the shelving and brings the boards closer together.

3. The marine vessel according to claim 1, wherein the shelving comprises a flexible material that collapses upon closing of the cover.

4. The marine vessel according to claim 1, wherein the shelving comprises a canvas material.

5. The marine vessel according to claim 1, wherein the slots are arranged in a stack, each slot having an open end for receiving one of the boards and a closed end opposite the open end, wherein the open ends are collapsed upon moving the cover into the closed position.

6. The marine vessel according to claim 5, further comprising an end wall defining the closed end of each slot.

7. The marine vessel according to claim 5, wherein the shelving includes shelves which collapse towards each other when the cover is moved into the closed position.

8. The marine vessel according to claim 7, wherein the shelving includes a flexible support member on each side of the shelving, the flexible support members being coupled to the cover and each of the shelves.

9. The marine vessel according to claim 8, wherein each shelf is coupled to and spaced apart along the flexible support members.

10. The marine vessel according to claim 8, wherein the flexible support members are located closer to the open end than the closed end.

11. The marine vessel according to claim 8, wherein the flexible support members are a first pair of flexible support members having a flexible support member located on each side of the shelving, and further comprising a second pair of flexible support members having a flexible support member located on each side of the shelving.

12. The marine vessel according to claim 1, wherein the cover is provided by a seat for the marine vessel.

13. The marine vessel according to claim 12, wherein the seat includes a seat back and a seat bottom which are transversely oriented relative to each other.

14. The marine vessel according to claim 12, wherein the shelving comprising a flexible material coupled to the cover and configured to move with the cover.

15. The marine vessel according to claim 12, wherein the cover is pivotable into and between the open position and the closed position.

16. The marine vessel according to claim 15, further comprising a gas spring for assisting movement of the cover toward at least one of the open position and the closed position.

17. The marine vessel according to claim 16, further comprising a latch which retains the cover in the closed position and is operable to permit movement of the cover into the open position.

18. The marine vessel according to claim 1, wherein the hatch faces a stern of the marine vessel.

19. The marine vessel according to claim 18, wherein the cover is provided by a seat of the marine vessel, and wherein the seat includes a seat bottom and a seat back, the seat back facing the stern when the cover is in the closed position.

20. The marine vessel according to claim 1, further comprising a deck and a hull, the cavity being at least partially defined between the deck and the hull.

* * * * *